US012692687B2

(12) United States Patent
Senanayake

(10) Patent No.: US 12,692,687 B2
(45) Date of Patent: Jul. 28, 2026

(54) PROTECTION SYSTEMS

(71) Applicant: 2MT MINING PRODUCTS PTY LTD, Queensland (AU)

(72) Inventor: Mahinda Palitha Senanayake, Queensland (AU)

(73) Assignee: 2MT MINING PRODUCTS PTY LTD, Queensland (AU)

( * ) Notice: Subject to any disclaimer, the term of this patent is extended or adjusted under 35 U.S.C. 154(b) by 377 days.

(21) Appl. No.: 17/629,556

(22) PCT Filed: Jul. 13, 2020

(86) PCT No.: PCT/AU2020/050722
§ 371 (c)(1),
(2) Date: Jan. 24, 2022

(87) PCT Pub. No.: WO2021/011994
PCT Pub. Date: Jan. 28, 2021

(65) Prior Publication Data

US 2022/0268001 A1 Aug. 25, 2022

(30) Foreign Application Priority Data

Jul. 24, 2019 (AU) ..... 2019902616

(51) Int. Cl.
*E02F 9/28* (2006.01)
*E02F 9/26* (2006.01)

(52) U.S. Cl.
CPC ..... *E02F 9/2883* (2013.01); *E02F 9/26* (2013.01); *E02F 9/2816* (2013.01); *E02F 9/2891* (2013.01)

(58) Field of Classification Search
CPC ..... E02F 9/28; E02F 9/2883; E02F 9/2858; E02F 9/2833; E02F 9/2808; E02F 9/285
(Continued)

(56) References Cited

U.S. PATENT DOCUMENTS 1,765,943 A * 6/1930 Lambert ..... H01K 1/465 439/303
3,736,664 A * 6/1973 Black ..... E02F 9/2883 37/446

(Continued)

FOREIGN PATENT DOCUMENTS

WO WO-2011127536 A1 * 10/2011 ..... E02F 9/2825
WO 2011156834 A1 12/2011

(Continued)

OTHER PUBLICATIONS

International Search Report and Written Opinion Received for the PCT Application No. PCT/AU2020/050722, mailed on Sep. 23, 2020, 17 pages.

*Primary Examiner* — Christopher J Sebesta
*Assistant Examiner* — Audrey L Lusk
(74) *Attorney, Agent, or Firm* — Amster, Rothstein & Ebenstein LLP

(57) ABSTRACT

A protection system includes a mount configured for attachment to a wear panel, a wear pad, and a locking member. The mount and wear pad have complementary engagement structures configured to enable relative sliding movement between the mount and the wear pad from a release position to an engaged position. The mount and the wear pad each have an opening or recess therein adapted to receive the locking member, which prevents sliding movement of the wear pad relative to the mount. The mount and the locking member each have at least one passage arranged to receive therein one or more bolts, which secure the locking member to the mount.

19 Claims, 30 Drawing Sheets

(58) Field of Classification Search
USPC ..... 37/455, 444
See application file for complete search history.

(56) References Cited

U.S. PATENT DOCUMENTS 4,457,380 A * 7/1984 Curry ..... E02F 3/8152 172/753
4,716,666 A * 1/1988 Potter ..... E02F 9/2883 37/448
5,055,336 A * 10/1991 Davis ..... B65G 11/166 428/167
5,056,243 A * 10/1991 Sprunger ..... E02F 9/2808 37/453
5,063,695 A * 11/1991 Briscoe ..... E02F 9/28 403/381
5,241,765 A * 9/1993 Jones ..... E02F 9/2883 172/772
5,913,605 A * 6/1999 Jusselin ..... E02F 9/28 403/380
6,041,529 A * 3/2000 Ruvang ..... E02F 9/2833 172/772
6,194,080 B1 * 2/2001 Stickling ..... E02F 9/2841 428/596
7,770,310 B2 * 8/2010 Keech ..... E02F 3/8155 37/455
8,561,326 B2 * 10/2013 Ruvang ..... E02F 3/401 37/452
9,499,958 B2 * 11/2016 Serrurier ..... E02F 9/2841
2014/0173949 A1 * 6/2014 Karlsson ..... E02F 9/2833 37/455
2015/0191899 A1 * 7/2015 Jones ..... E02F 9/2883 37/444
2016/0237658 A1 * 8/2016 Ruvang ..... E02F 9/2883

FOREIGN PATENT DOCUMENTS

WO WO-2015054741 A1 * 4/2015 ..... E02F 9/2825
WO WO-2015105798 A1 * 7/2015 ..... E02F 3/40
WO WO-2018157189 A1 * 9/2018 ..... F16B 5/07

* cited by examiner

PROTECTION SYSTEMS

FIELD OF INVENTION

This invention relates to protection systems for earthmoving, mining, conveying, crushing and processing equipment and the like. In particular, the invention relates to protection systems for protecting faces of machinery which would otherwise be contacted by abrasive material moving relative thereto.

Such faces include the inside faces of conveyor chutes, the faces of face shovel buckets and excavator buckets and dragline buckets especially the outside bottom faces, the upper face of haul truck beds, and various faces of many other types of machinery which would otherwise be subject to abrasive wear or wear by other component contact.

BACKGROUND OF RELATED ART

Some known face protection systems typically incorporate two main components, the first component being a mount which rests on the face of the item to be protected and is retained by welding it on to the item to be protected and the second being a wear plate or wear pad (or runner) which is removably mounted, secured, or locked to the mount.

For example, in the case of a face shovel, the bottom face of the shovel bucket normally engages the work face from which overburden, coal, iron ore or some other material is being taken (referred to generally herein as spoil) and consequently needs to be protected from abrasive wear, A typical protection system includes a plurality of adjacent wear plates or wear pads removably mounted on a corresponding plurality of mounts which are welded to the outer face of the bottom wall of the bucket or whichever panel is subject to wear, the wear pads thereby effectively covering or almost covering the entire bottom face of the bucket or wear face of the panel.

When the wear pads wear to a predetermined extent, the wear pads are removed from the mounts and replaced by new wear pads on the same mounts. Eventually the mounts also become too worn and then must be removed and replaced by new mounts.

In this specification, the term "wear panel" is intended to encompass panels of equipment or machinery such as side walls and bottom walls of face shovels, excavator buckets, dragline buckets, walls of conveyor chutes and similar panels unless the context clearly requires a different meaning. The term may also extend to other components such as rigging components which might be subject to abrasive wear.

One of the difficulties faced by protection systems is that wear pads can loosen on their respective mounts which results in an increased wear rate of both the wear pads and their respective mounts. Such loosening can be the result of wear between the wear pad and the mount or loosening of the locking or securing mechanism due to abrasive wear of the locking mechanism itself or in the case of buckets, continual changing of movement of the bucket in various directions such as changing from the forward direction to the backward direction and vice versa. Various attempts have been made to overcome or ameliorate problems associated with protection systems but problems still remain.

SUMMARY

The present invention is aimed at providing a protection system which is relatively simple and effective.

In this specification, unless the context clearly requires a different meaning, the term forward and its derivatives are to be understood as being in the direction of movement of the bucket, blade or other working part when digging, filling or transferring spoil. Terms such as upper, lower, side, front, rear, and the like are to be understood in the context of the bucket, blade or other working part so that the leading-edge of the bucket is the edge of the bucket at the front where spoil enters the bucket or the leading edge of the blade where contact is initially made with the spoil. In the case of a working part such as a chute, the entry point of the spoil would be the leading edged or end although terms like entry point or exit may be used.

With the foregoing in view, the invention resides broadly in a protection system including:

- a mount adapted to be fixed to a wear panel of equipment or machinery, said mount having a lower face adapted to rest against a face of the wear panel to be protected and an upper face spaced from said lower face;
- a wear pad adapted to be releasably mounted on or to said mount; and
- a locking member adapted to lock said wear pad to said mount;
- said mount and said wear pad having complementary engagement means adapted to allow relative sliding movement between said mount and said wear pad from a release position in which said wear pad can be pushed onto or pulled off said mount to an engaged position in which said wear pad cannot be pulled from said mount;
- said mount and said wear pad each having an opening or recess therein adapted to receive said locking member at least partially therein, said recess and said opening being arranged to at least partially align when said mount and said wear pad are in the engaged position such that said locking member extends from said opening or recess in said wear pad into said recess or opening in said mount so as to prevent sliding movement of said wear pad relative to said mount towards the release position; and
- said mount further having at least one passage extending from said lower face into said opening or recess and adapted to receive therein a bolt;
- said locking member also including at least one passage, said at least one passage being aligned with said at least one passage in said mount whereby a bolt extending through said at least one passage in said mount may also extend through said locking member; and
- one or more bolts extending through said at least one passage in said mount and said at least one passage in said locking member to secure said locking member to said mount.

In another aspect, the invention resides broadly in a mount for a protection system, said mount including:

- a first portion having a lower face adapted to rest against a face of the wear panel to be protected and an upper face spaced from said lower face;
- one or more protuberances extending from said first portion on opposite sides thereof, each of said protuberances having a face which tapers upwards or outwards or upwards and outwards from said lower face towards one end of said first portion and terminates at said upper face;
- said first portion having an opening or recess therein and at least one passage extending from said lower face into said opening or recess, said at least one passage having a relatively narrow end portion and a larger portion contiguous with said narrow end portion, said narrow end portion being selected to slidably receive the shank of a bolt (or the locking portion of a bolt head) for lateral movement thereof relative to the first portion and the larger portion being selected to axially receive the head of the bolt whereby a bolt may be fitted to the mount from above by pushing the head through the larger portion and then sliding the bolt laterally into the end portion where the head of the bolt may then engage the lower face of the first portion adjacent the passage.

In yet another aspect, the invention resides broadly in a wear pad for a protection system, the wear pad including:

a wear portion having an upper face adapted to bear against ore or spoil to be moved and a lower face spaced from said upper face and adapted to rest on or adjacent a mount secured to a wear panel to be protected, said wear portion having at least one passage extending therethrough from said upper face to said lower face, the upper face being defined at least in part by an outer portion extending substantially about said passage; and two spaced apart side portions extending or depending from said wear portion on opposite sides thereof to define a space therebetween and one or more protuberances extending from each of said side portions towards the opposite side portion and spaced from said lower face, each of said protuberances having a face which tapers upwards or inwards or upwards and inwards towards said lower face and extending towards one end of said wear portion, said one or more protuberances being spaced laterally away from said at least one passage.

Preferably, the upper face of the wear pad is defined at least in part by a perimeter portion and a channel or valley portion between said perimeter portion and said at least one passage and extending substantially about said passage, said channel or valley portion being shaped and sized to achieve a predetermined wear pattern.

Preferably said wear pad includes wear indication means for indicating when the wear pads have worn to a predetermined state so that they can be replaced by new wear pads at an appropriate time. In a preferred form, the indication means are provided by blind passages extending from the lower face of the perimeter portion towards the upper face of the perimeter portion. It will be appreciated that as the perimeter portion of the wear portion wears, the upper face will become closer and closer and closer and eventually the blind passages will open to the upper face and be visible thereby indicating it is time to replace the pads.

Preferably, said at least one passage extending from said lower face into said opening or recess includes a portion adapted to receive therein the head of the bolt, the depth of such portion being selected so that the head of the bolt does not protrude beyond the lower face of the mount. It is also preferred that the bolts selected are plow bolts and that the shape and size of the head portion of the recess be shaped to suit the size and shape of the head portion of the plow bolt.

It is also preferred that said at least one passage in said mount is a single passage having relatively narrow end portions and a larger intermediate portion, the narrow end portions being selected to slidably receive the shank of the bolt (or the locking portion of the bolt head) for lateral movement and the intermediate portion being selected to axially receive the head of the bolt whereby a bolt may be fitted to the mount from above by pushing the head through the intermediate portion and then sliding the bolt laterally towards either end portion where the head then engages the lower face of the mount adjacent the passage. It will be appreciated that in such form, each of the narrow end portions can accommodate a bolt each of which can be fitted through the intermediate portion and in such case, said at least one passage in said locking member can be two passages or a single long slot.

In a preferred form, the width of the narrow end portions is selected to engage with the square locking portion of the bolt or bolt head to prevent the bolt turning relative to the passage as is well known in the use of plow bolts. It is also preferred that the depth of the head portion of the recess be such as to ensure that the locking portion of the bolt head is retained in the narrow end portion so that a suitable nut can be screwed onto the bolt without the bolt turning. In a preferred form the nuts selected are security lock nuts.

Preferably the mount has one or more openings extending therethrough to provide suitable locations for welding the mount to the panel to be protected. In such form, it is preferred that at least two openings extending laterally across the mount be provided, one being near one end of the mount and the other near the opposite end. Advantageously, positioning of the openings in such manner allows lateral welds to be made near to each end so that the mount is less likely to peel from the underlying panel by any load is applied to the wear pad secured to the mount.

Preferably, the at least one passage or passages in said locking member includes a portion adapted to receive therein the nut of the bolt or bolts as the case may be, such portion being sufficient to accommodate a suitable spanner or socket for tightening or loosening the nut as the case requires.

Preferably the locking member has recesses in each end and/or each side for engagement by a removal tool such as a lever or a lifting hook. Alternatively, the locking member may have a threaded jacking passage therein by which a jacking bolt may be screwed into the locking member so as to bear against the mount or the wear panel below to which the mount is secured such that the locking member can be jacked out by screwing in a suitable jacking bolt.

Preferably, said complementary engagement means include a tapered portion or portions and a complementary tapered recess or recesses, the tapers being arranged to force the wear pad towards the panel being protected, that is, into closer face to face engagement with the mount towards a transition or interference fit as the wear pad is slid from the release position into the engaged position. It is also preferred that the complementary engagement means include tapered portions arranged to tighten the wear pad onto the mount against lateral movement or twisting or pivoting movement as the wear pad is slid from the release position to the engaged position. In a more preferred form, the complementary engagement means incorporates a tapered portion or portions and complementary recesses which achieve both desired functions.

Preferably said mount includes at least two protuberances extending from each side of said first portion, said protuberances on each side being spaced apart in a direction from end to end. In a more preferred form, the mount includes three protuberances extending from each side of said first portion and preferably the protuberances are arranged in pairs, one protuberance of each pair being directly opposite its corresponding protuberances on the other side.

BRIEF DESCRIPTION OF THE DRAWINGS

In order that the invention may be more readily understood and put into practical effect, reference will now we need to the accompanying drawings wherein.

DETAILED DESCRIPTION OF THE EMBODIMENTS

Figure 1:
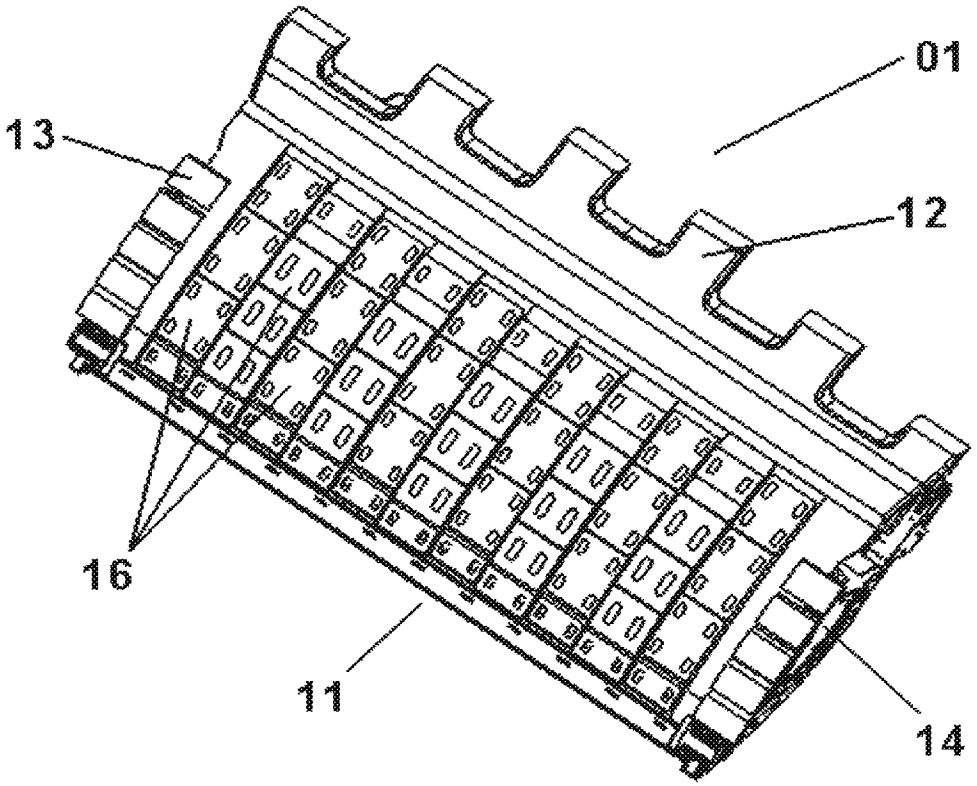
Fig.1 (PRIOR ART)
FIG. 1 is a pictorial representation of the bottom of a face shovel bucket with prior art wear pads welded to the outer face of the bottom of the bucket.

The prior art face shovel bucket 01 illustrated in FIG. 1 has a bottom panel 11 which extends rearward from a front cutting lip 12 and is contiguous with a rear wall (not shown) and two spaced apart opposing side walls 13 and 14, extending from the bottom panel 11 and terminating at lip 12. An array of wear pads 16 arranged in rows and columns are welded to the outer face of the bottom panel 11 to form an almost continuous external liner which can be removed and replaced. However, in order to remove the wear pads 16, the weld material has to be removed by gouging or grinding or similar operation which can be time-consuming and costly.

Figure 2:
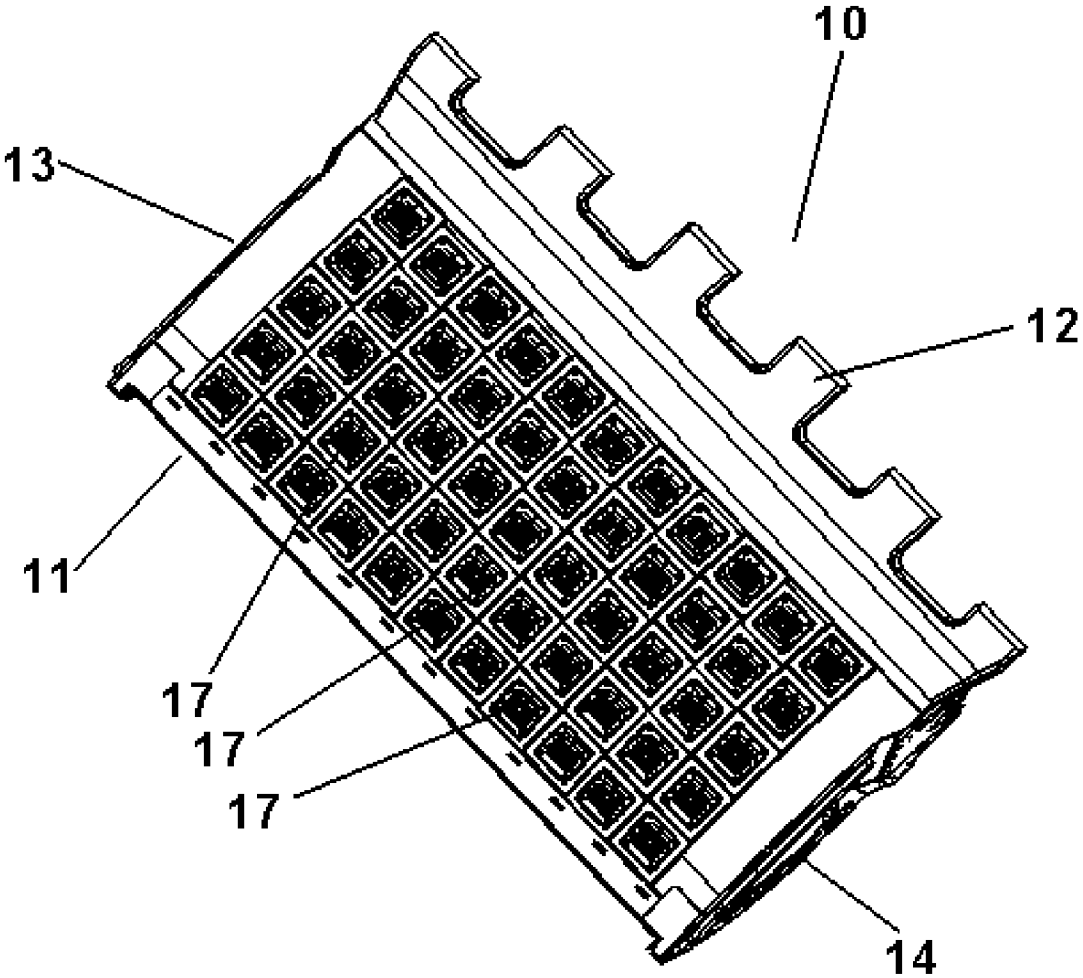
FIG. 2 is a pictorial representation of the bottom of a face shovel bucket with wear pads according to the present invention secured to the outer face of the bottom of the bucket.

The face shovel bucket 10 illustrated in FIG. 2 is the same as the face shovel bucket 01 illustrated in FIG. 1 except that the bucket 01 has been fitted with a protection wear pad assembly 17 which includes wear mounts 20 and wear pads 60 according to the present invention, instead of the prior art wear pads 16, as will be described in more detail later.

The wear mount 20 illustrated in FIGS. 3*a* to 3*f* is manufactured in one piece of cast steel and has a first portion (or mid portion) 21 of generally rectangular form with a leading end 22, an opposite trailing end 23, and two spaced apart opposite sides 24 and 25. Opposed pairs of protuberances 26 and 27, 28 and 29, and 30 and 31 extend outwardly from the sides 24 and 25 respectively, the protuberances being shaped to engage with complementary recesses provided in a wear pad as will be described later.

Figures 3A, 3B:
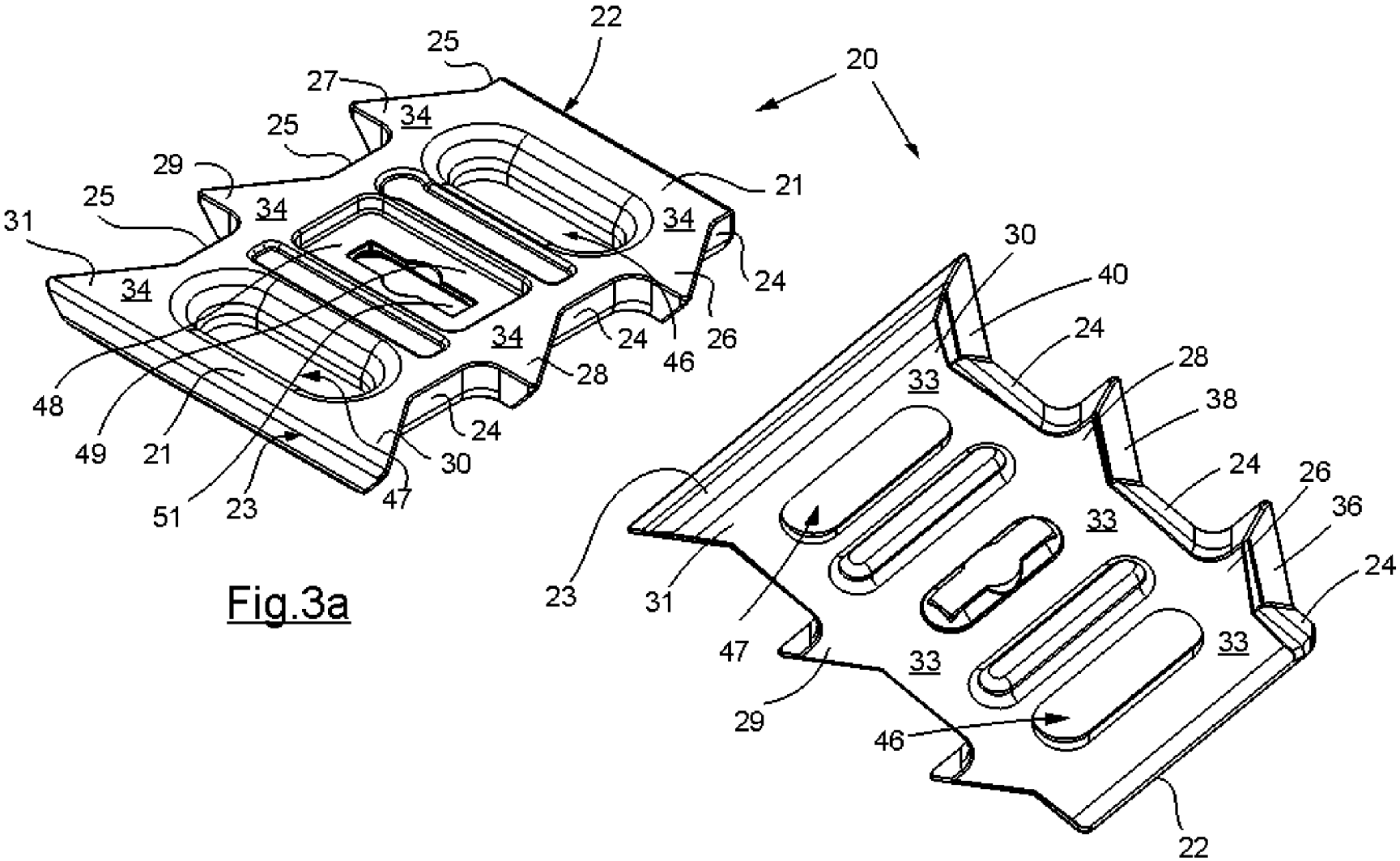
FIG. 3*a* is a pictorial representation of a weld on mount according to the present invention from the outer face and tailing end.
FIG. 3*b* is a pictorial representation of the weld on mount of FIG. 3*a* from the inner face.
Figure 3D:
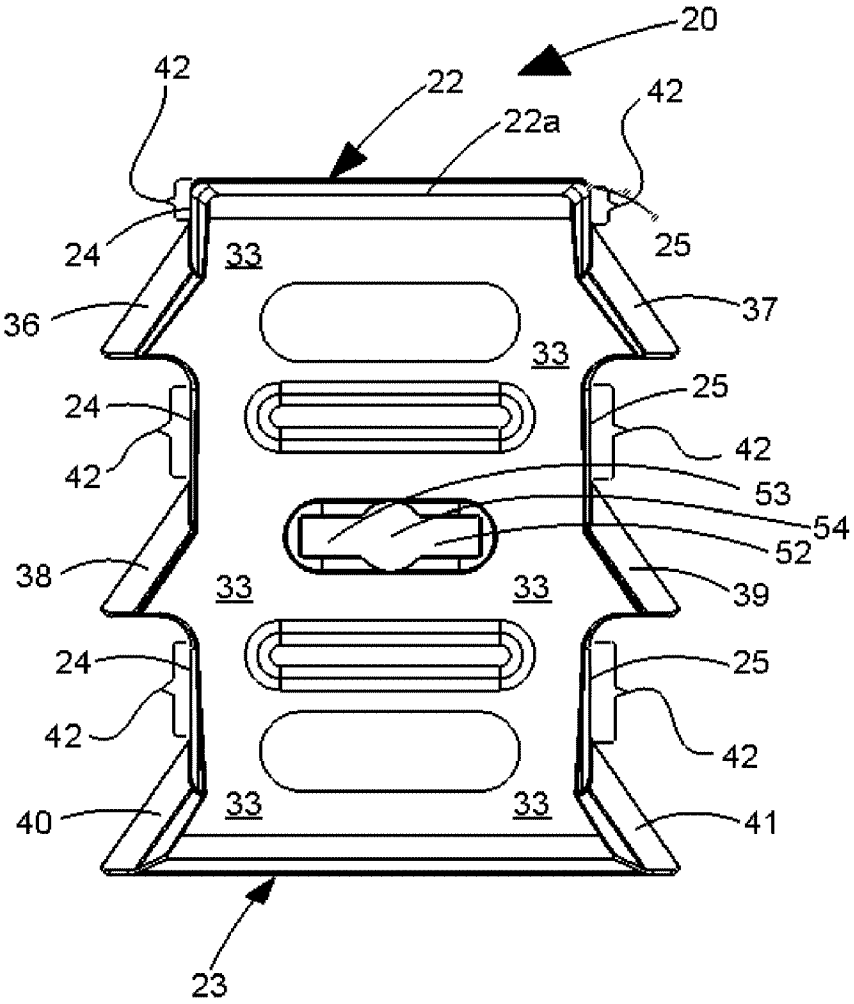
FIG. 3*d* is an inner face plan view of the weld on mount of FIG. 3*a;*
Figure 3C:
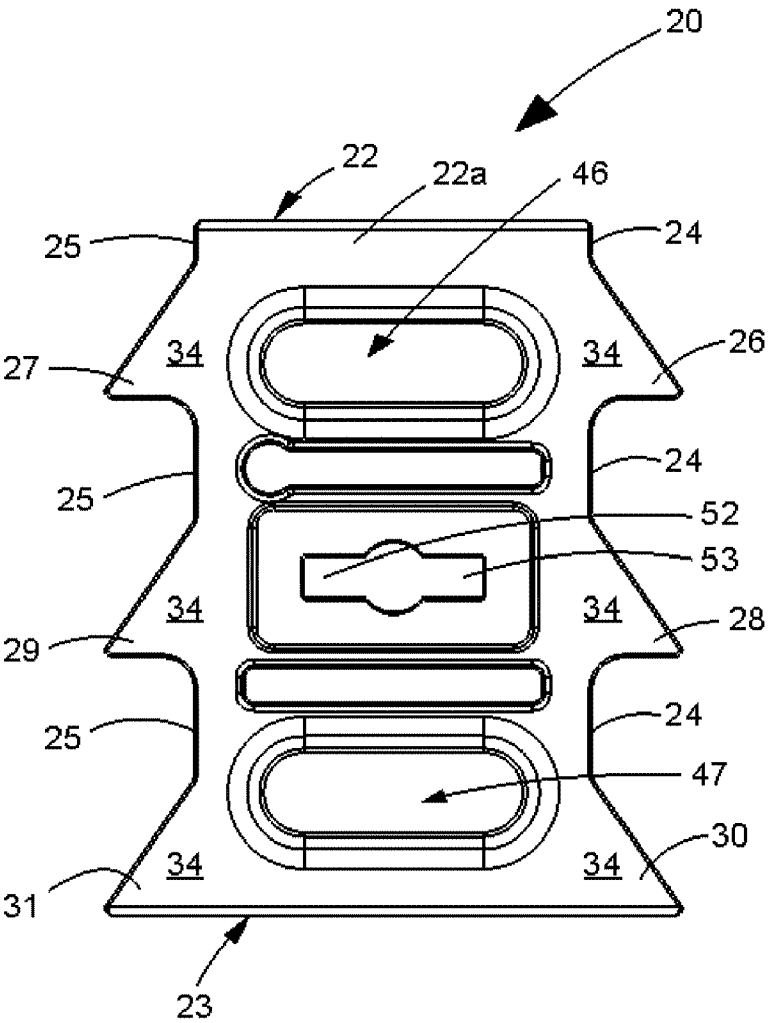
FIG. 3*c* is an outer face plan view of the weld on mount of FIG. 3*a;*
Figure 3F:
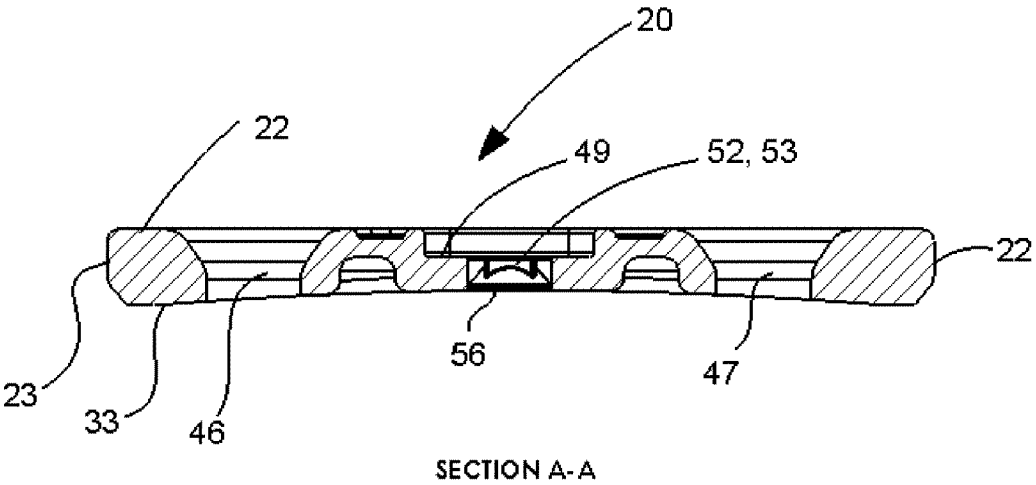
FIG. 3*f* is a cross-sectional side view of the weld on mount of FIG. 3*a* from one side along line A-A.
Figure 3E:
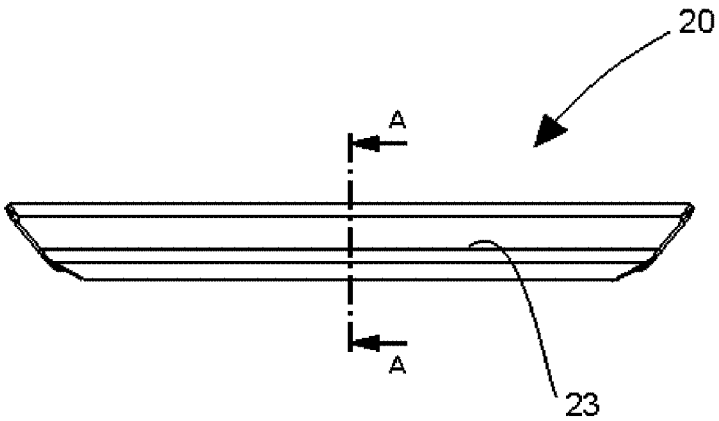
FIG. 3*e* is an end view of the weld on mount of FIG. 3*a* from the trailing end.

Suitably, the mount has a slightly curved lower face (or inner face) 33 as can be seen in FIG. 3*f* which is adapted to rest on the curved wear face of the panel to which the mounts are to be secured by welding, the lower face of the protuberances being contiguous to some extent with the lower face of the mid-portion.

The mount has a generally planar upper face (or outer face) 34 spaced from the lower face 33 and generally parallel thereto although not curved. However, in other embodiments, the upper face 34 could also be curved in much the same manner about the same axis but at a greater radius. In other embodiments the lower face 33 may be planar to suit a planar flat panel to be protected, for example, the bottom panel of a dragline bucket. In such case, the upper face 34 may also be planar. In some cases, the thickness of the mount 20 may vary from end to end to achieve a flat or curved wear face as desired.

The leading end 22 extends fully across the width of the mid portion 21 while the trailing end 23 extends fully across the width of the mid portion and across the width of the protuberances 30 and 31 such that the protuberances 30 and 31 together with the midportion define the trailing end while only the mid portion defines the leading end.

Advantageously, the leading faces 36 to 41 of the protuberances 26 to 31 taper rearwards away from the leading end 22 and outwards from the mid-portion 21 at about 55 degrees which allows three protuberances to fit along each side. The leading faces 36 to 41 also taper upwards from the lower face to the upper face at a true angle of about 55 degrees.

Advantageously, the spacing 42 between the adjacent protuberances, for example between protuberances 26 and 28 or 28 and 30 is selected to accommodate corresponding protuberances provided on the wear pads so that the wear pad can be pushed onto the mount and then slid into the locking position as will be described in more detail later.

Two passages 46 and 47 (the welding passages), one adjacent the leading end and one adjacent the trailing end extend through the first portion (or mid portion) and almost fully across the mid portion, the passages being of sufficient width in the leading end towards trailing end direction to allow a MIG welding nozzle to fully weld the mount to the panel to which it is to be affixed by way of a fillet weld all around the internal perimeter of those two passages 46, 47.

A recess 48 is provided in the mount between the two welding passages, the recess being generally rectangular in shape and adapted to receive partially therein a locking member 90 or locking block of generally rectangular prism form as will be described in more detail later. The recess 48 has a floor 49 which the locking member is intended to engage and an elongated passage 51 extends through the mid portion of the mount from the floor 49 to the lower face 33. The elongated passage 51 has two opposed narrow end portions 52 and 53 contiguous with a larger center portion 54. Advantageously, the center portion is generally circular in cross section and adapted to receive therethrough from the upper face of the midportion, the head of a plow bolt. Suitably, the narrow end portions are rectangular in cross section and sized to allow the square shank portion of the selected plow bolts to slide therein to their desired positions at the respective ends of the narrow and portions 52 and 53 without rotating about the bolt axis. As can be seen in FIG. 3*f*, recesses 56 are provided in the mid-portion to accommodate the heads of the plow bolts therein, the recesses being shaped to prevent the plow bolts from rotating relative to the mount.

The wear plate 60 illustrated in FIGS. 4*a* to 4*g* is manufactured in one piece of cast steel and is generally of square form. The wear plate has a first portion (or wear portion) 61 of generally rectangular form with a leading end 62, an opposite trailing end 63, and two spaced apart opposite side portions 64 and 65 depending from the wear portion 61.

The wear portion 61 has an upper face 66 adapted to bear against ore or spoil to be moved and a lower face 67 spaced from said upper face between the side portions 64 and 65 and adapted to rest on or adjacent the mount 20 when the mount is secured to a wear panel to be protected. Referring to FIGS. 4*a* and 6*c*, 6*e*-6*f*, a locking member passage 86 extends through the upper face 66 and lower face 67. The upper face 66 of the wear portion 61 includes a raised perimeter portion 80, a raised interior portion 81 extending at least substantially about a perimeter of the passage 86, and a channel or valley portion 82 formed between the raised perimeter portion 80 and the raised interior portion 81 about the passage 86. The raised perimeter portion 80 and the channel or valley portion 82 extend at least substantially about the passage 86. The raised perimeter portion 80 has a height, which extends in a direction normal to the lower face 67 of the wear part 60, that is greater than heights of the channel or valley portion 82 and the interior portion 81 extending about the passage 86.

Opposed pairs of protuberances 68 and 69, 70 and 71, and 72 and 73 extend inwardly from the side portions 64 and 65 respectively, the protuberances being shaped to engage with complementary protuberances 26 to 31 provided on the mount 20. In that respect, it will be appreciated that the protuberances 68 to 73 of the wear plates have respective inner faces 68*a* to 73*a* which are arranged to fit within the respective spaces 42 of the mount 20.

Suitably, the lower face (or inner face) 67 is generally planar to match upper face (or outer face) 34 of the mount. However, in cases where the mount has a curved upper face, the inner face of the wear plate can have a corresponding curve.

Advantageously, the leading faces 78 to 83 of the protuberances 68 to 73 taper rearwards away from the leading end 22 and outwards away from the opposite side at about the same angle as the corresponding protuberances of the mount. The leading faces 78 to 83 also taper downwards away from the inner or lower face 67 towards the opposite side at a true angle of about 45 degrees.

The passage 86 is provided in the wear pad 60, more or less centrally located, the passage 86 corresponding in shape to the recess 48 in the mount 20 and being generally rectangular in cross section parallel to the inner face 67. The passage 86 is shaped and sized to receive therein the same locking member 90 or locking block of generally rectangular prism form mentioned earlier. Two opposite further recesses 87 extend into the wear portion 61 from passage 87 for receiving therein a lifting tool for removing the wear pad 60 from the mount 20 when replacement is required.

Figure 4A:
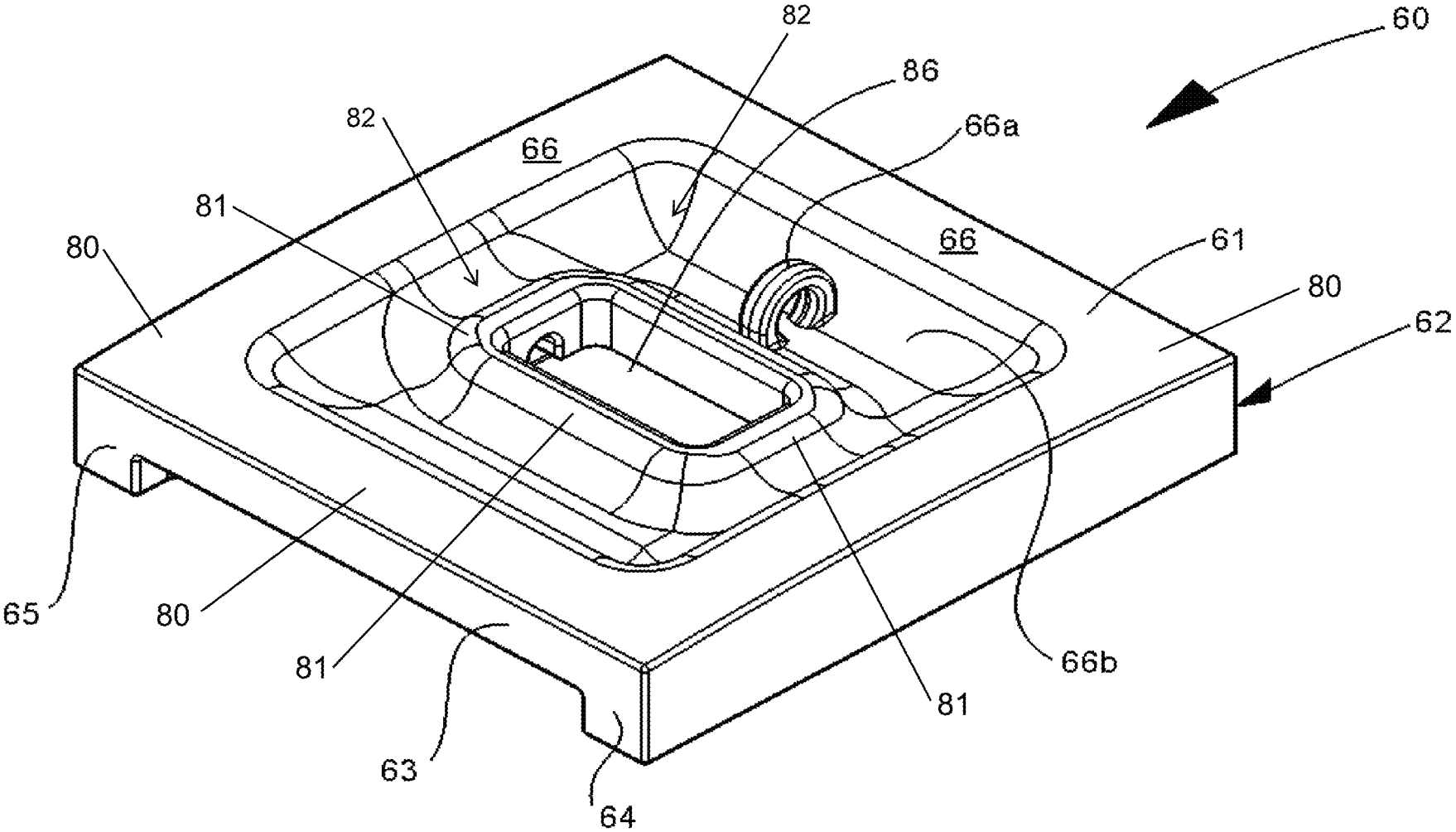
FIG. 4*a* is a pictorial representation of a wear pad according to the present invention from the wear face and trailing end.
Figure 4B:
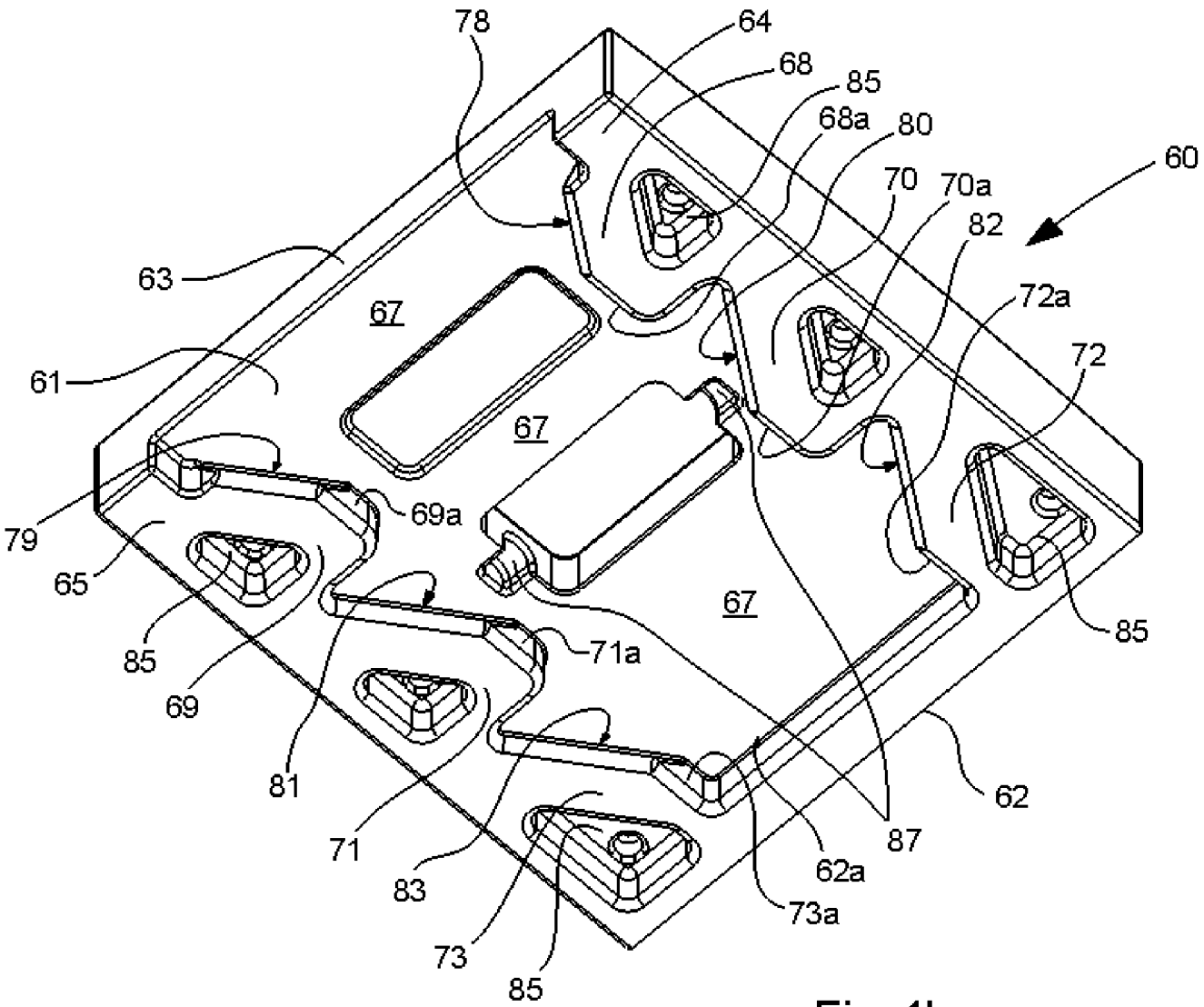
FIG. 4*b* is a pictorial representation of the wear pad of FIG. 4*a* from the upper side (the side which engages the weld on mount)
Figure 4D:
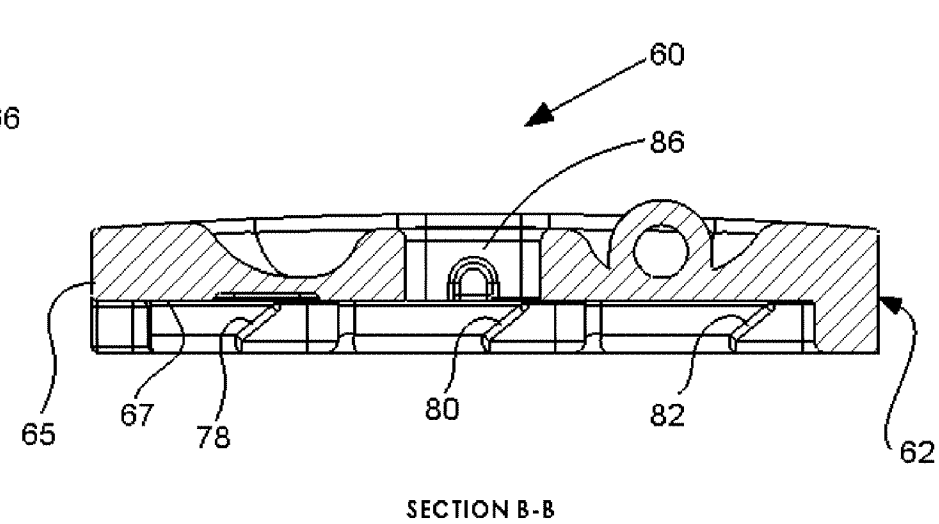
FIG. 4*d* is a sectional side elevation along line B-B of the wear pad of FIG. 4*a;*
Figure 4C:
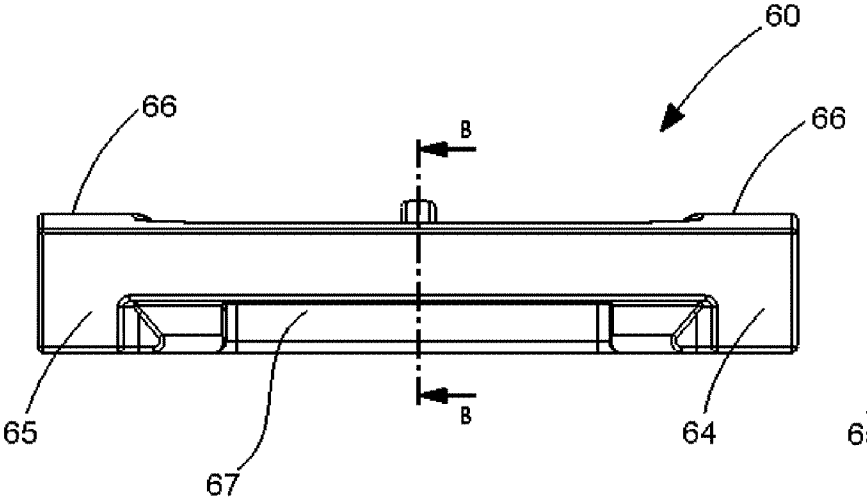
FIG. 4*c* is an end view of the wear pad of FIG. 4*a* from the trailing end.
Figure 4F:
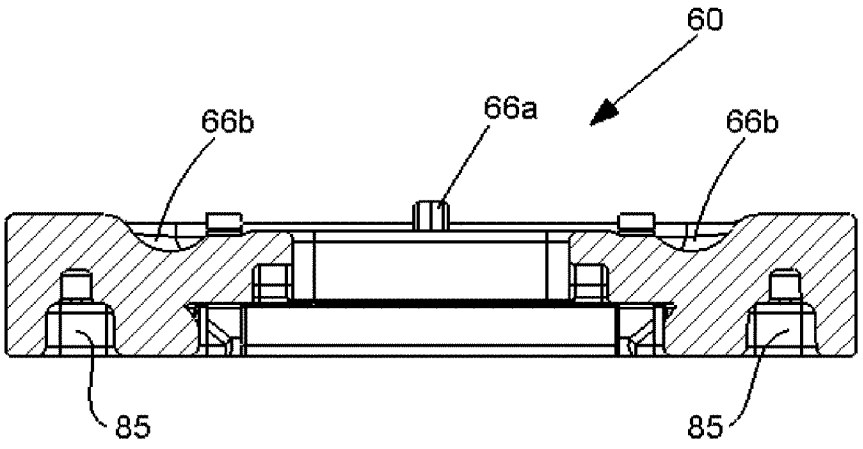
FIG. 4*f* is a sectional end view of the wear pad of FIG. 4*e* along line C-C.
Figure 4G:
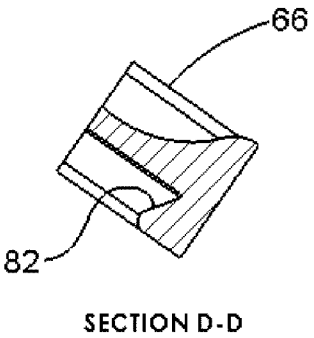
FIG. 4*g* is a sectional view of part of the wear pad of FIG. 4*c* along line D-D.
Figure 4E:
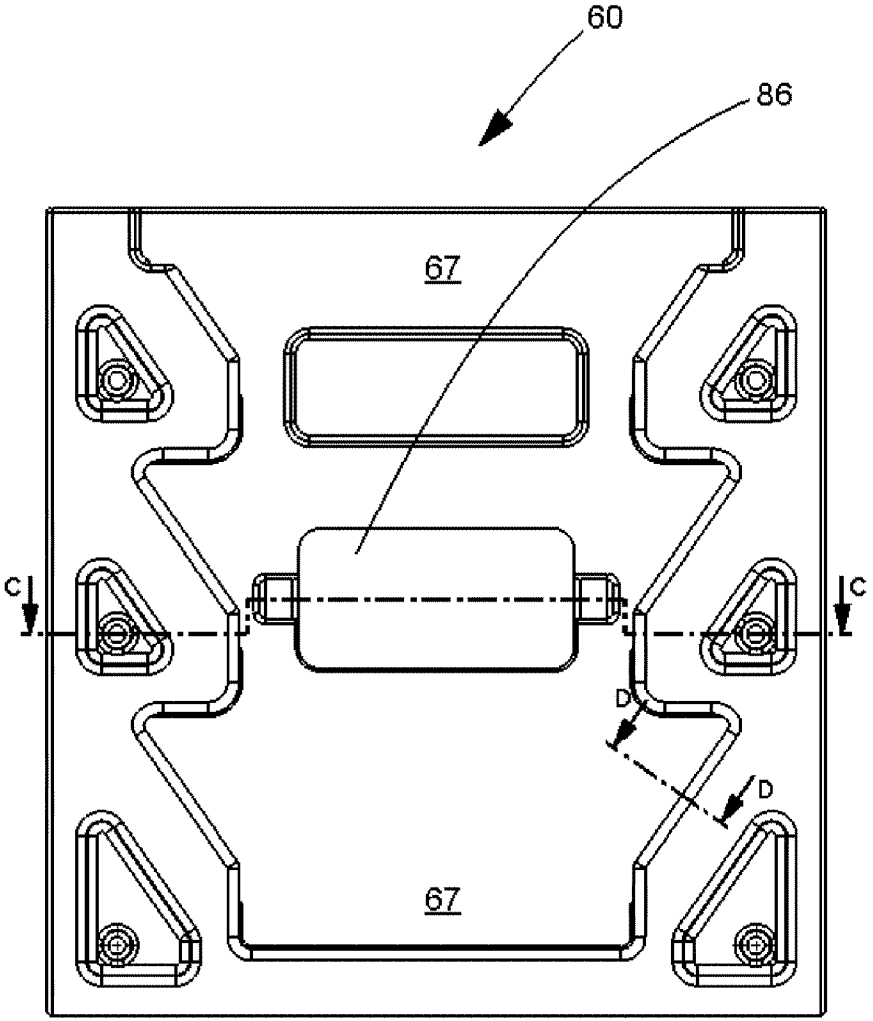
FIG. 4*e* is an inner face plan view of the wear pad of FIG. 4*a;*
Figure 4H:
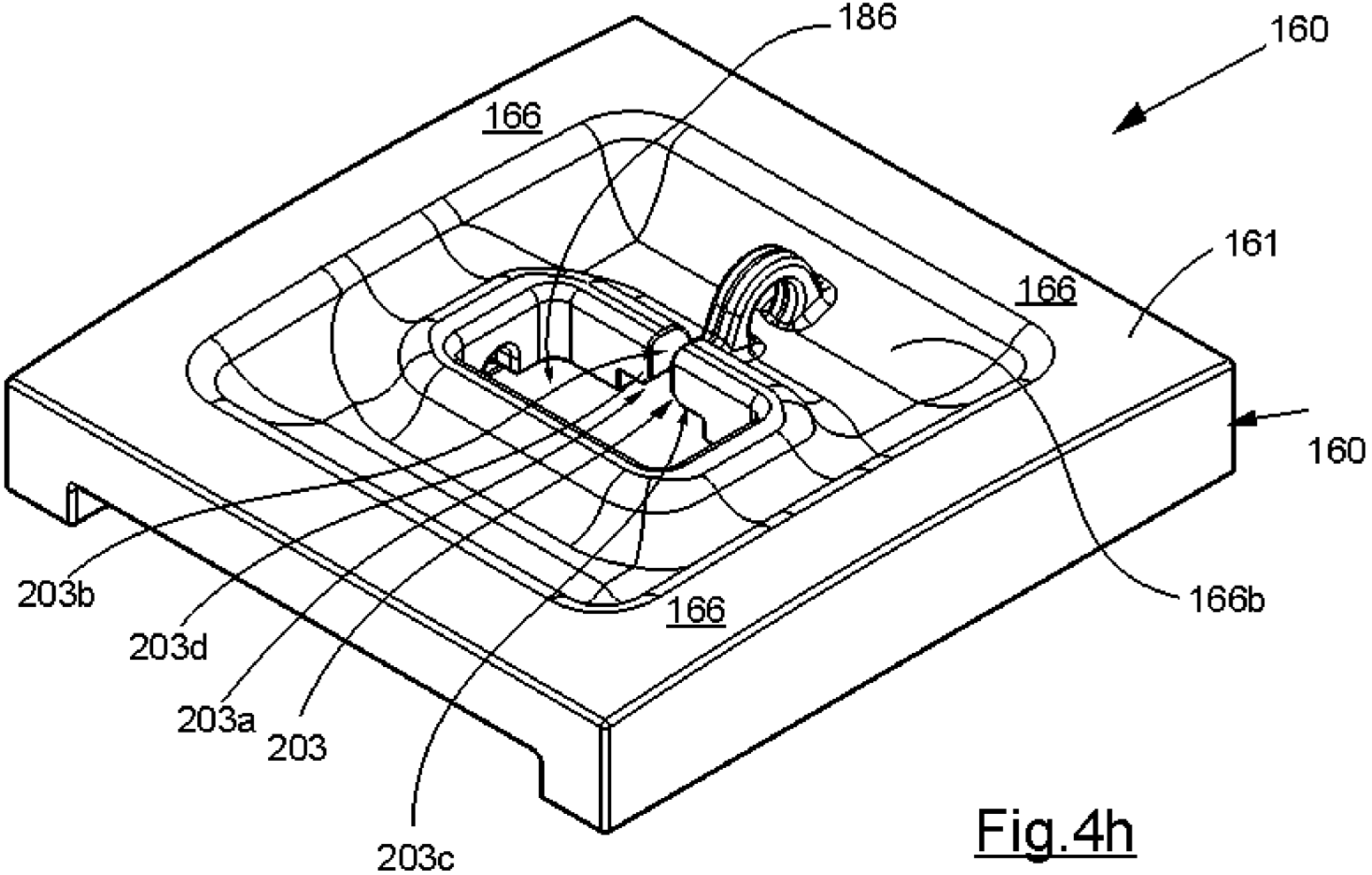
FIG. 4*h* is a pictorial representation of another wear pad according to the present invention from the wear face and trailing end.

The alternative wear pad 160 illustrated in FIG. 4*h* is the same as that illustrated in FIG. 4*a* in most respects and accordingly corresponding features will be referenced by corresponding numbers except prefaced by a "1". The main difference from wear pad 60 is that an additional recess 203 is provided for receiving therein a different tool for assisting in removal of the wear pad from the mount when replacement is required. For that purpose, the recess is generally shaped in cross section from side to side like an upside down "T" with a top portion 203*a* which forms the leg of the "T" and a bottom portion 203*b* which forms the head of the "T" thereby providing spaced apart shoulders 203*c* and 203*d* on opposite sides of the leg of the "T". The shoulders are suitably sized for engagement by a lifting tool as will now be described.

Figure 4J:
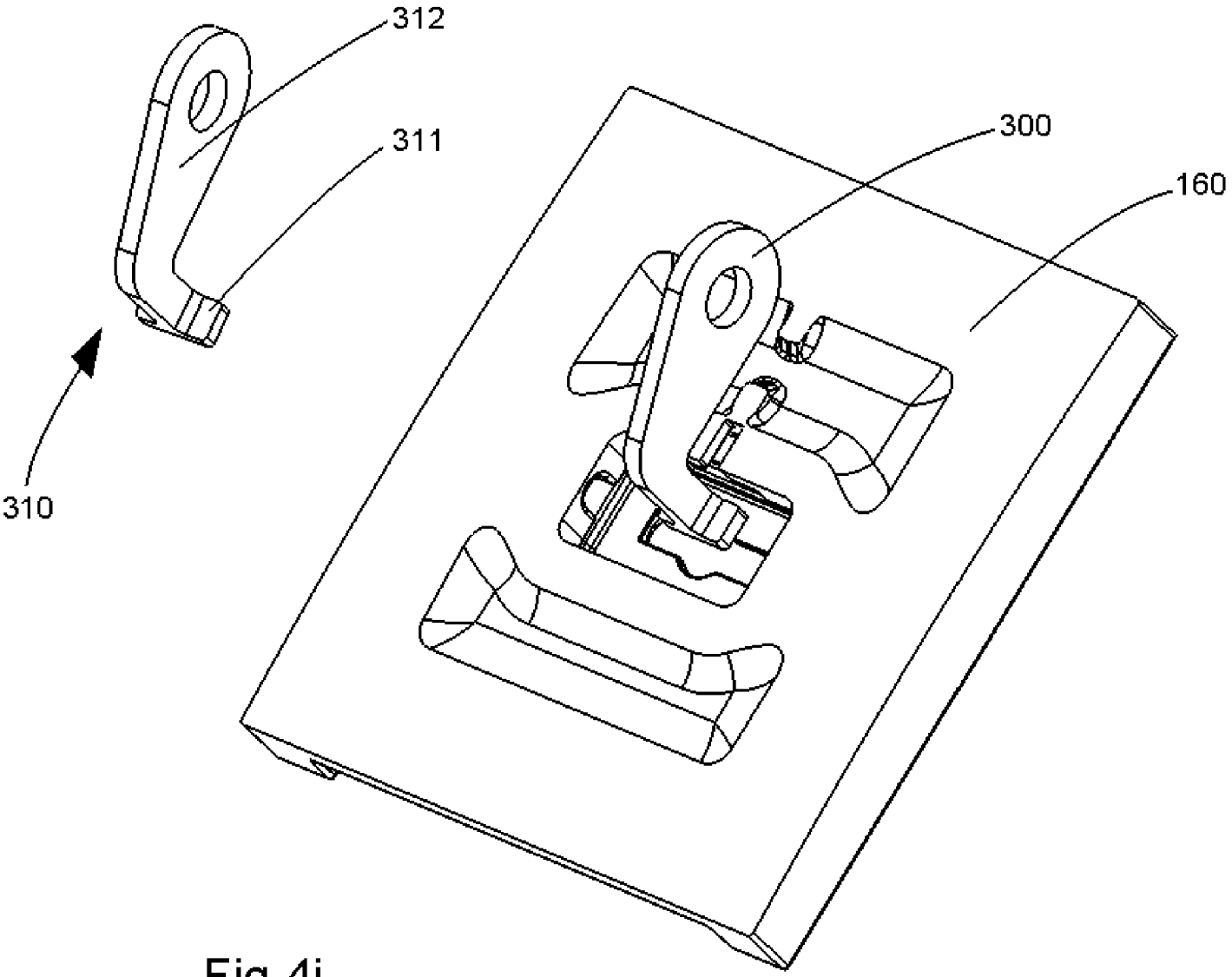
FIG. 4*j* is a pictorial representation of the wear pad of FIG. 4*h* with a tool partially in place ready to assist in removal of the locking block therefrom.
Figure 4K:
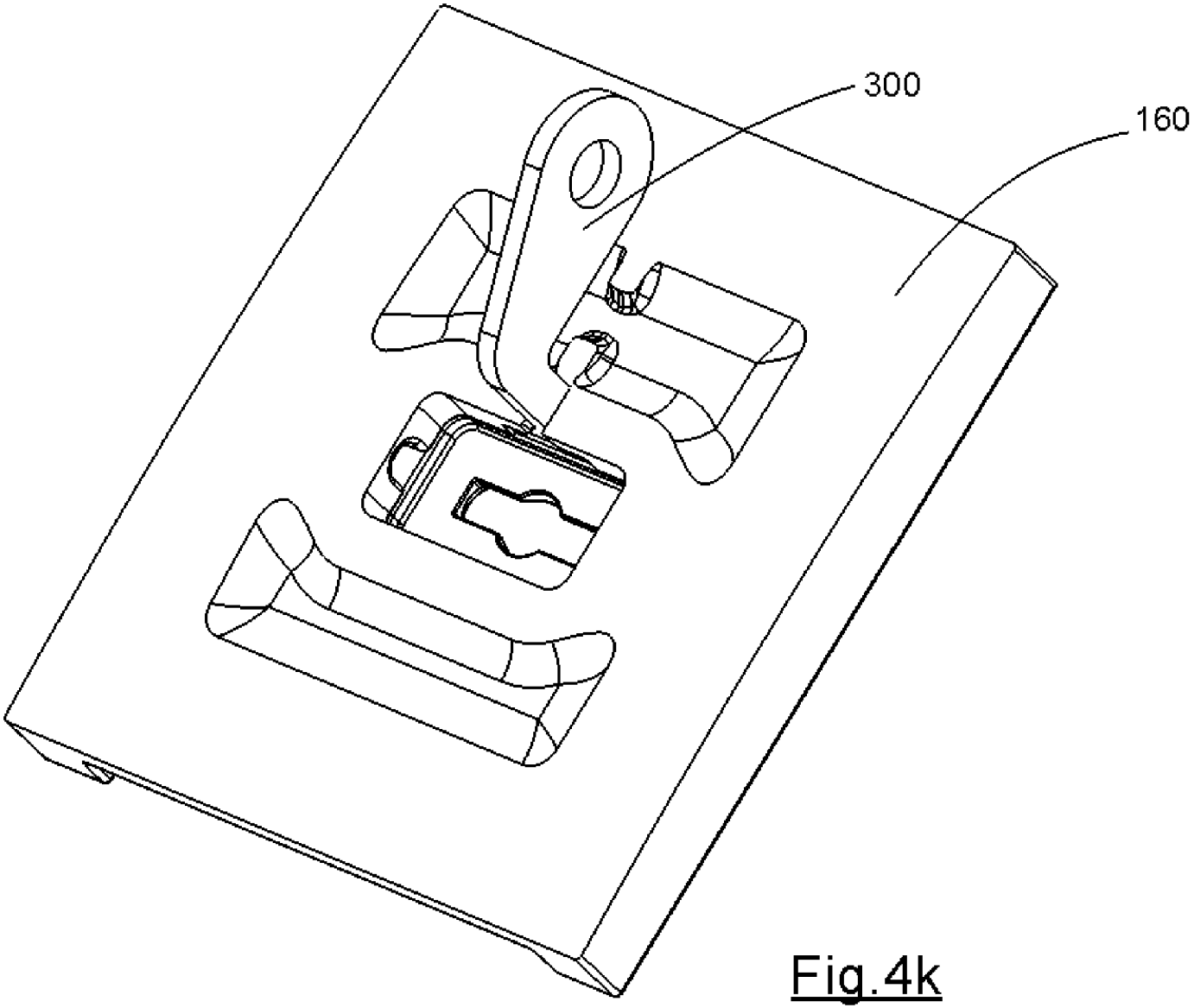
FIG. 4*k* is a pictorial representation of the wear pad of FIG. 4*h* with the tool fully in place ready to lift the locking block therefrom.

As can be seen in FIGS. 4*j* and 4*k*, the lifting tool 310 has a substantially upside down "T" shaped bottom portion 311 forming the head of the "T" suitably sized for engagement in recess portion 203*a* and an extended handle portion 312 forming the leg of the "T" and providing a lifting leg for the tool. Suitably, the bottom portion of the "T" is a comfortable fit in the bottom portion of the recess and the lifting leg is a comfortable fit in the handle portion of the recess whereby it supports the wear pad during removal of a worn wear pad.

Figure 4M:
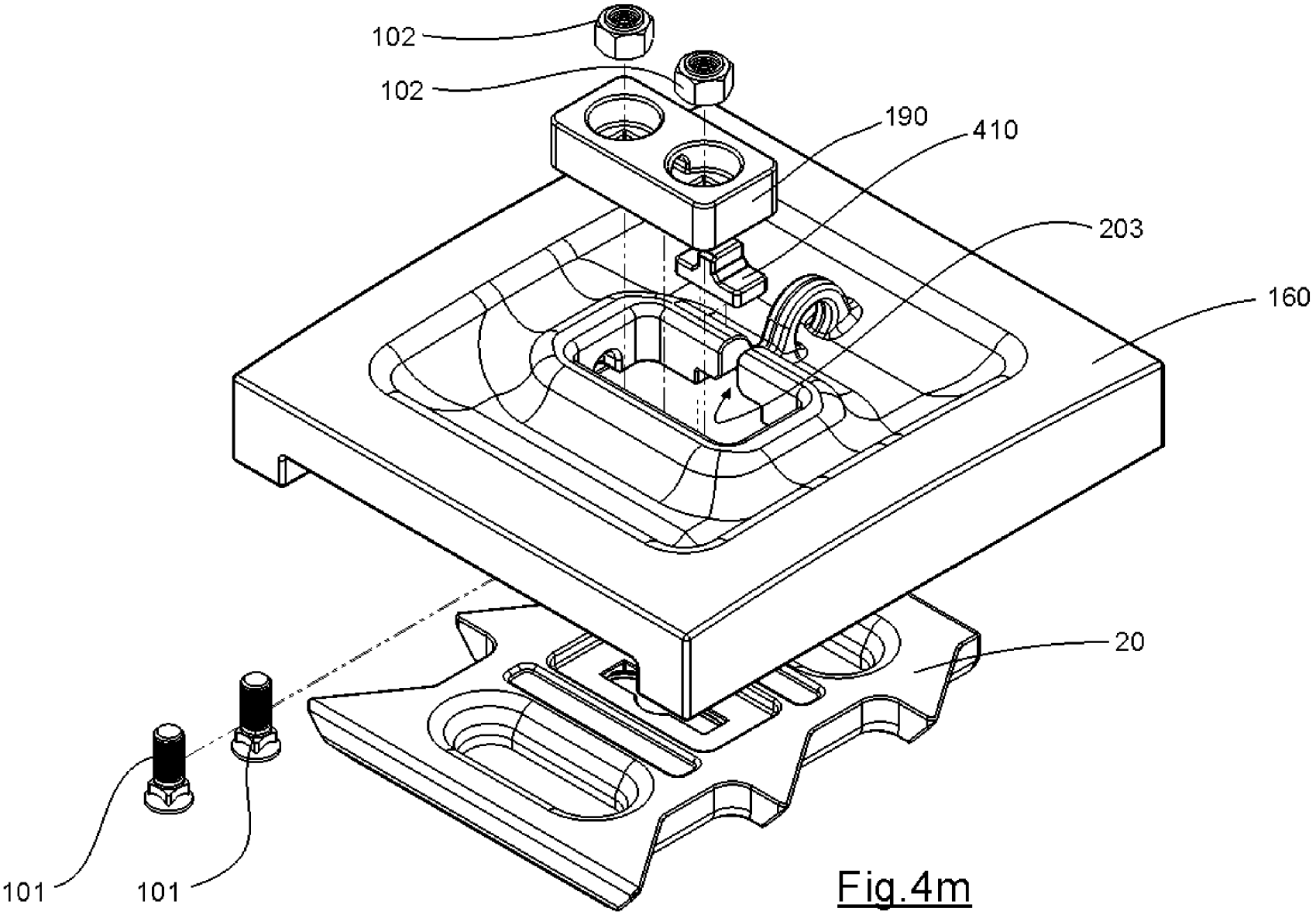
FIG. 4*m* is a pictorial representation of the wear pad of FIG. 4*h* with a plastic insert ready to be fitted in the tool recess.

As can be seen in FIG. 4*m*, an upside down "T"-shaped plastic plug 410 is also provided to fill recess 203 when a new wear plate is being fitted. In that respect, the plug fills recess 203 until it is removed after removal of retainer block 190 from passage 186 to inhibit build-up of fines therein until it is removed to allow access of the lifting tool 310.

Figure 5B:
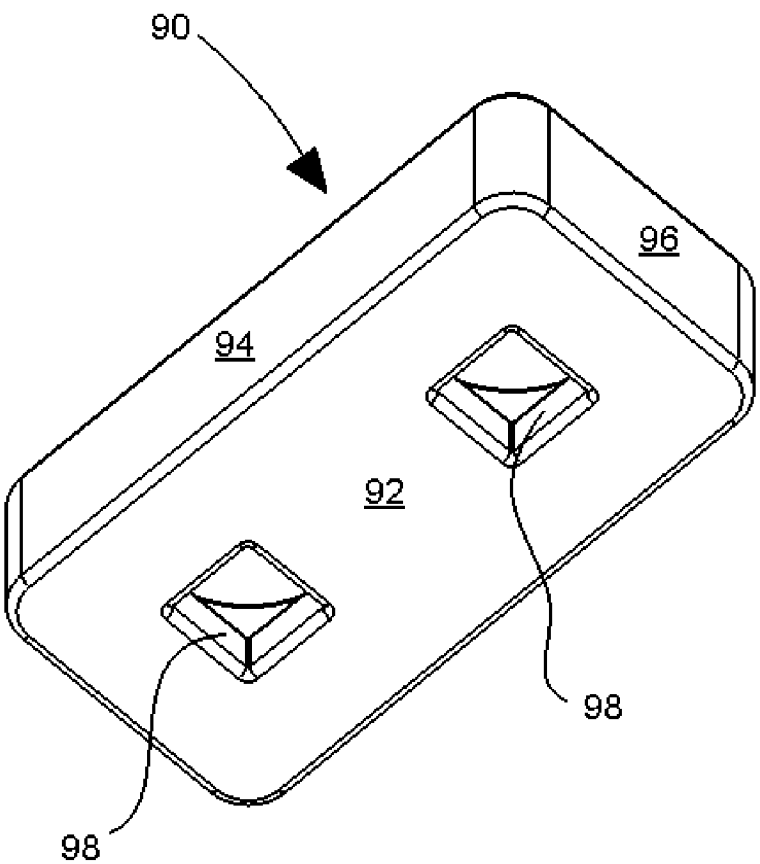
FIG. 5*b* is a pictorial representation of the locking member of FIG. 5*a* from an inner face.
Figure 5A:
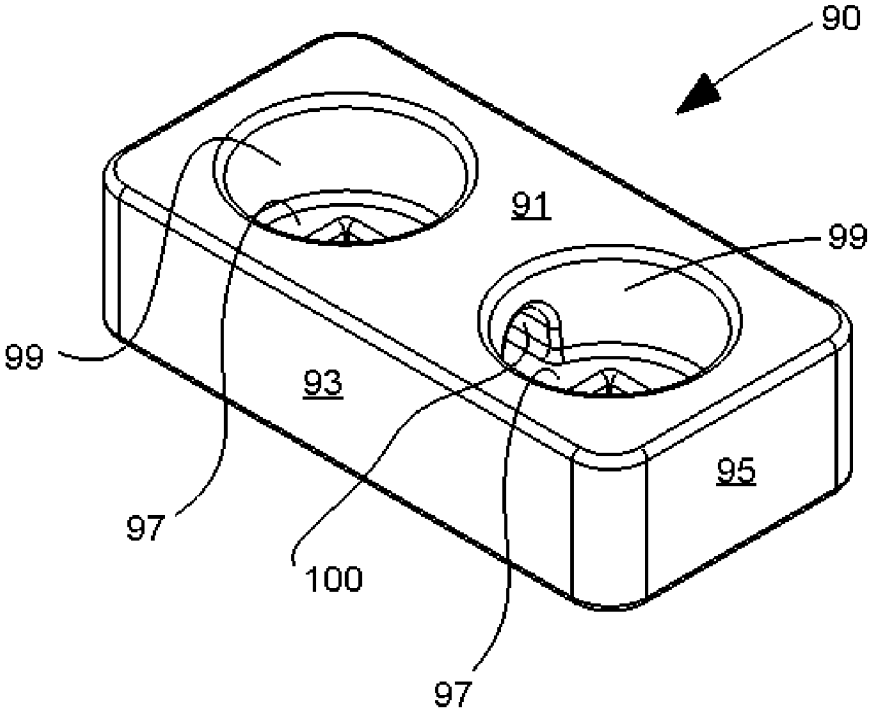
FIG. 5*a* is a pictorial representation of a locking member (or locking block) according to the present invention from an outer face.
Figures 5C, 5D, 5E:
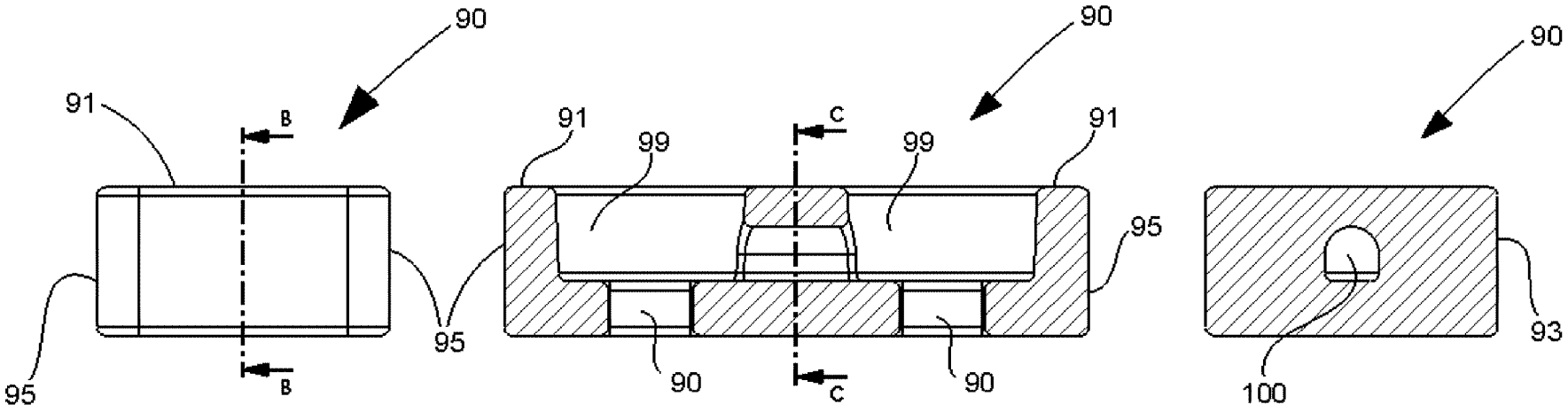
FIG. 5*c* is an end elevation of the locking member of FIG. 5*a;*
FIG. 5*d* is a sectional side elevation of the locking member of FIG. 5*c* along B-B.
FIG. 5*e* is a sectional end elevation of the locking member of FIG. 5*c* taken along line C-C of FIG. 5*d*.

The locking member (or locking block) 90 illustrated in FIGS. 5*a* and 5*b* is substantially a rectangular prism having an upper face 91, a lower face 92, opposed side faces 93 and 94, and opposed end faces 95 and 96. Two spaced apart passages 97 extend through the mounting block from the upper face 91 to the lower face 92, the passages 97 having an end portion 98 adjacent the lower face which is square in cross section and opens into a larger portion 99 adjacent the upper face which is circular in cross section. Suitably, the lower square cross-section portion is adapted to engage with the square head portion of a plow bolt while the upper circular cross-section portion is adapted to rotatably receive therein a nut for the plow bolt. A passage 100 extends from one of the cylindrical portions 99 to the other for receiving therein a lifting tool for lifting the mounting block from the wear pad when replacement is required.

In use, a plurality of mounts 20 are welded to the outer face of the bottom panel 11 of excavator or face shovel bucket 10 to form an array in which the bottom panel will be more or less entirely covered by the wear pads 60 when fitted to the mounts In the first step, mounts 20 are welded to the bottom panel of the bucket in the desired spaced apart positions as can be seen in FIGS. 8*a* to 8*d* by fillet welds along leading end 22 and trailing end 23 and within obround weld passages 46 and 47.

When all the mounts have been welded to the bottom panel, the wear pads 60 are fitted to the mounts. The fitting step involves aligning the protuberances 68 to 73 of the wear pad with the spaces 42 between adjacent protuberances 26 to 31 and then pushing the wear pad into the "release position". At that point, it will be appreciated that the wear pad 60 is not secured to the mount 20. The securing step which follows requires the wear pad to slide along outer face 34 of the mount from the release position to the engaged position, wherein the tapered faces 78 to 83 of the wear plate protuberances to engage with the complementary tapered faces 36 to 42 of the mount protuberances.

It will be appreciated that the arrangement of the tapered faces is such that the tapers pull the wear pad into facial engagement with the mount and also tighten the wear pad against the sides of the mount thereby preventing or at least inhibiting sideways movement of the wear pad relative to the mount, longways movement from the leading end towards the trailing end, screwing or pivoting movement of the wear pad relative to the mount about a perpendicular axis extending from the outer face of the mount, and skewing movement as well. Advantageously, leading end portion 22*a* of the mount 20 engages within leading end recess 62*a* of the wear pad close to the leading end 22 while trailing end 23 engages with tapered faces 78 and 79 of the wear pad.

Figure 6A:
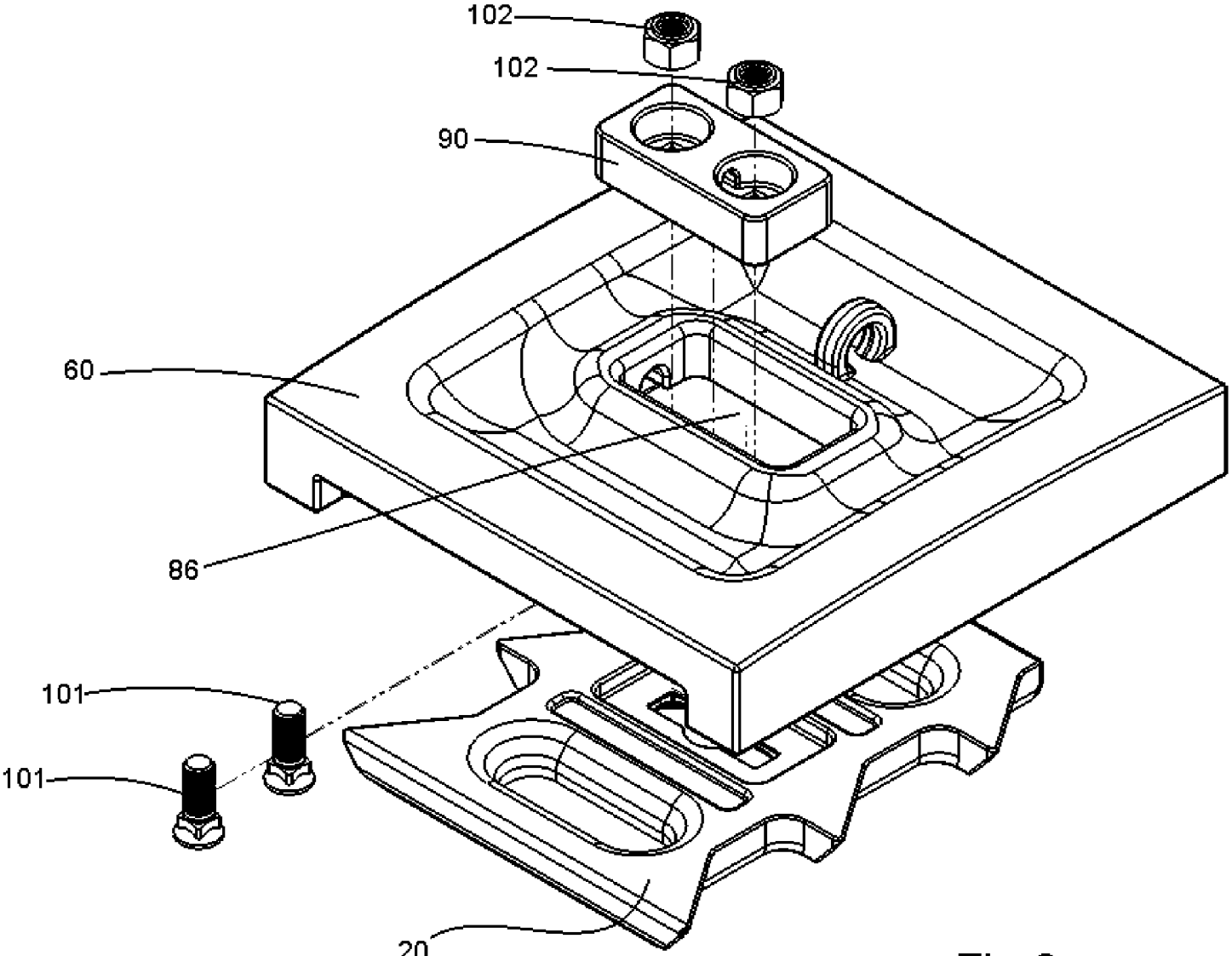
FIG. 6*a* is a pictorial representation of the mount of FIG. 3*a*, the wear pad of FIG. 4*a* and the mount of FIG. 5*a* in line for assembly and also showing plow bolts and nuts.
Figure 6B:
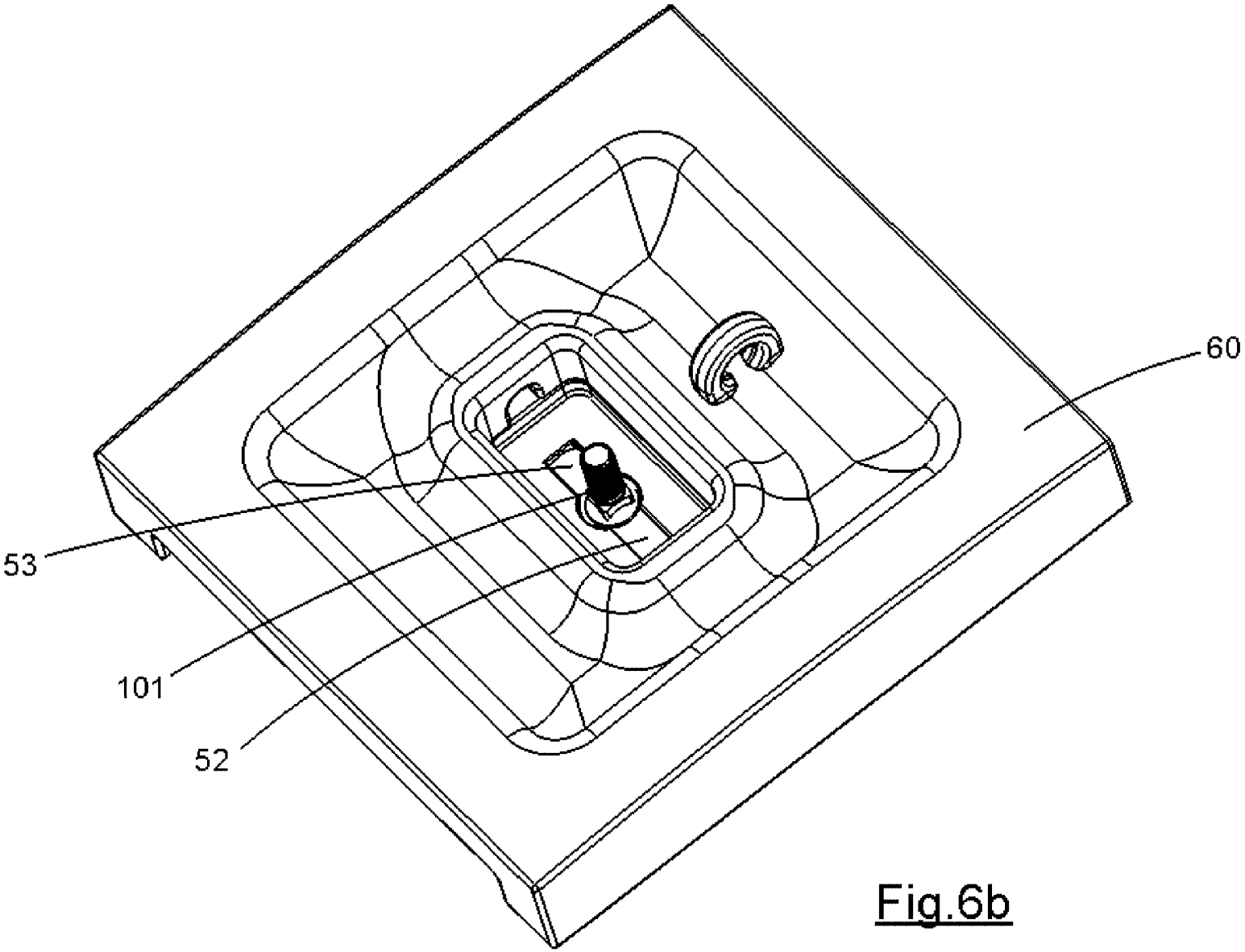
FIG. 6*b* is a pictorial representation of the mount of FIG. 3*a*, and the wear pad of FIG. 4*a* with one of the plow bolts being fitted and in an intermediate position.
Figure 6C:
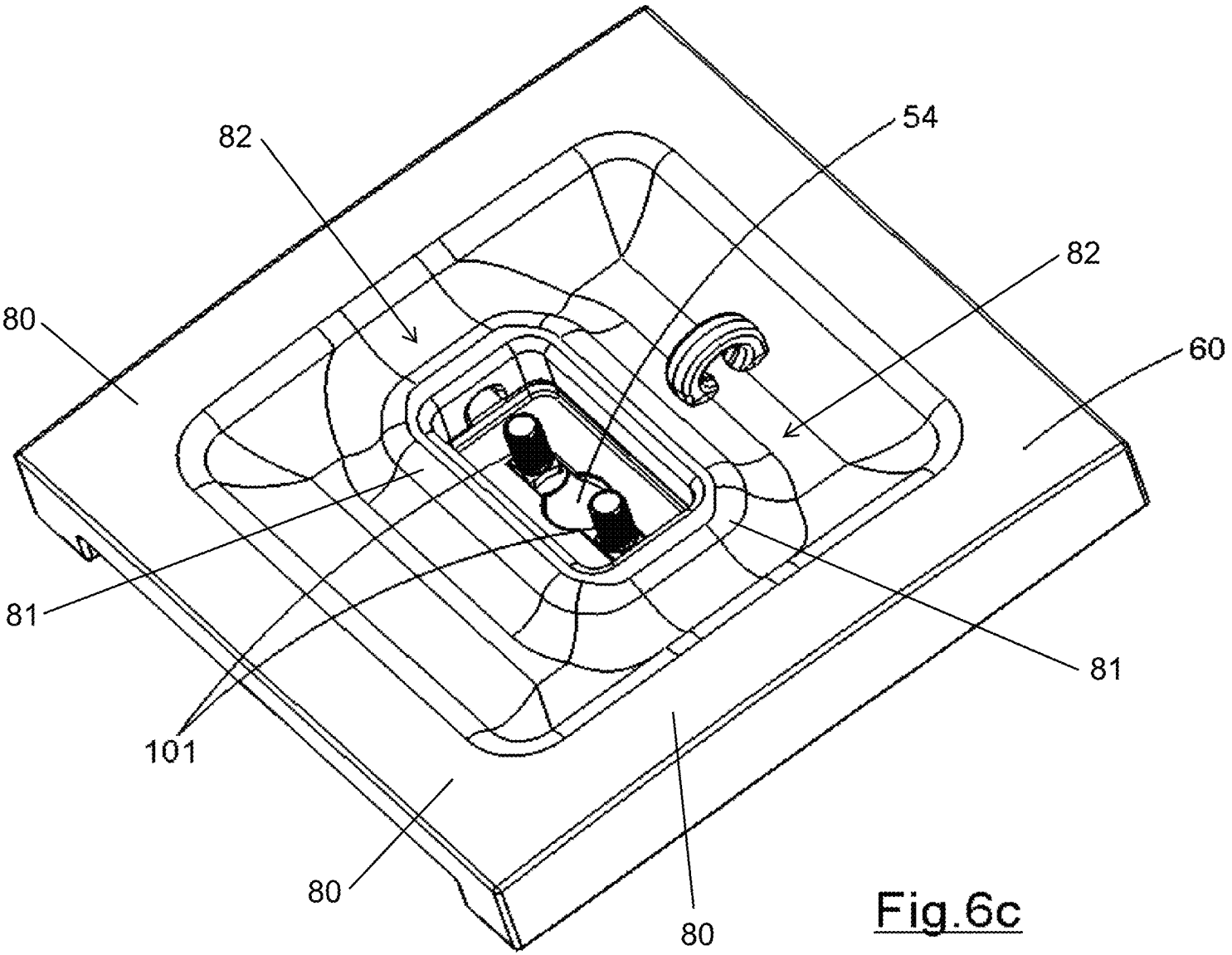
FIG. 6*c* is a pictorial representation of the mount of FIG. 3*a*, and the wear pad of FIG. 4*a* with the plow bolts fitted and ready for the locking member to be fitted.

Referring to FIGS. 6*a*-6*c*, upon the wear pad 60 being moved to the engaged position on the mount 20, the locking member (or locking block) 90 is ready to be fitted. Firstly, the plow bolts 101 are fitted to the mount 20. Initially, the head of the first plow bolt is pushed through large center portion 54 of center passage 51 and rotated about its longitudinal axis to align the square part of the shank with the narrow portion 52 or 53 of the passage and then the bolt is slid to one end. The same process is then carried out for the second plow bolt except that it is pushed to the other end of the remaining narrow portion so that the two bolts extend outwards from the floor 49 of recess 48.

Figure 6D:
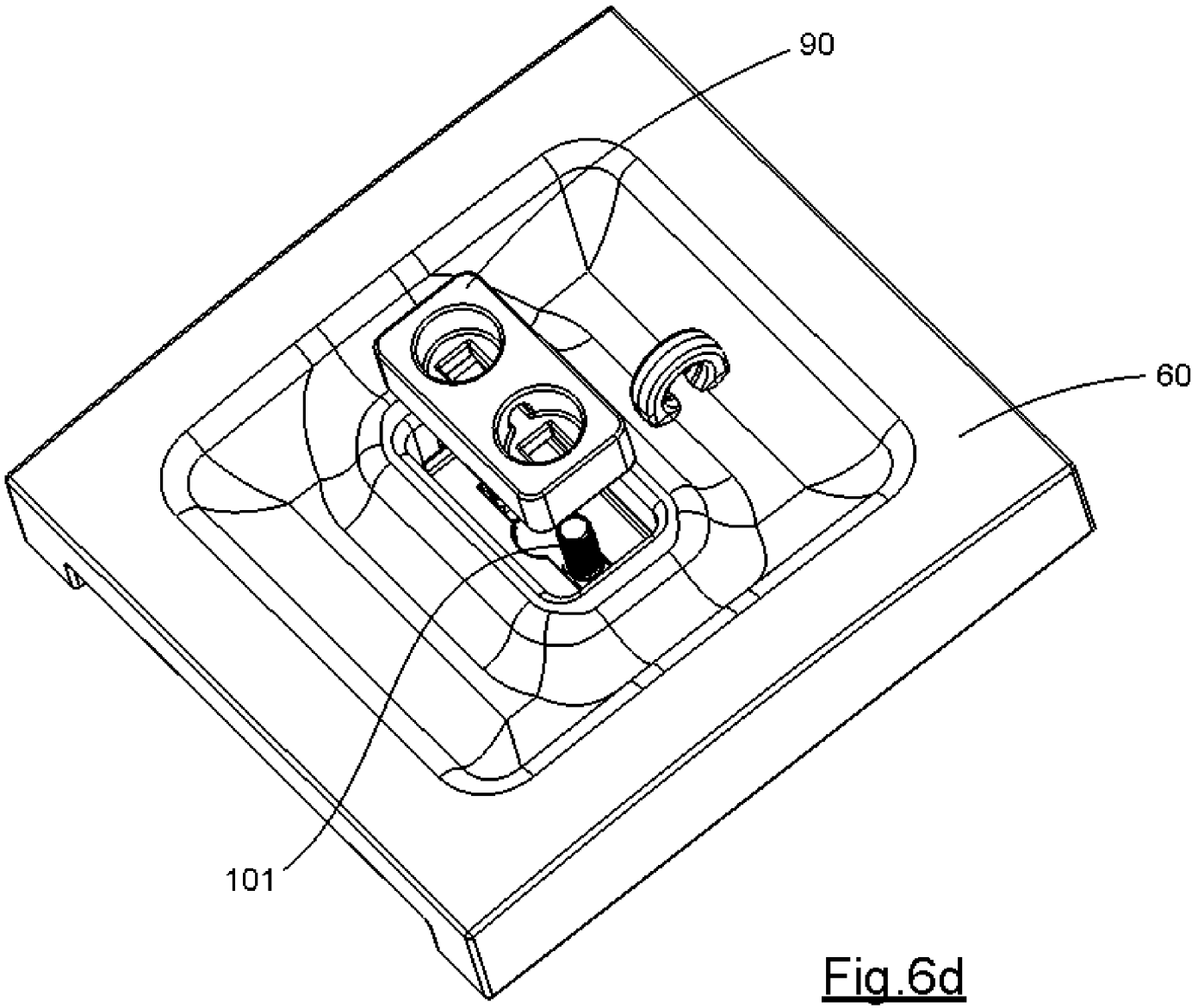
FIG. 6*d* is a pictorial representation of the mount of FIG. 3*a*, and the wear pad of FIG. 4*a* with the plow bolts fitted and the locking member being fitted.
Figure 6E:
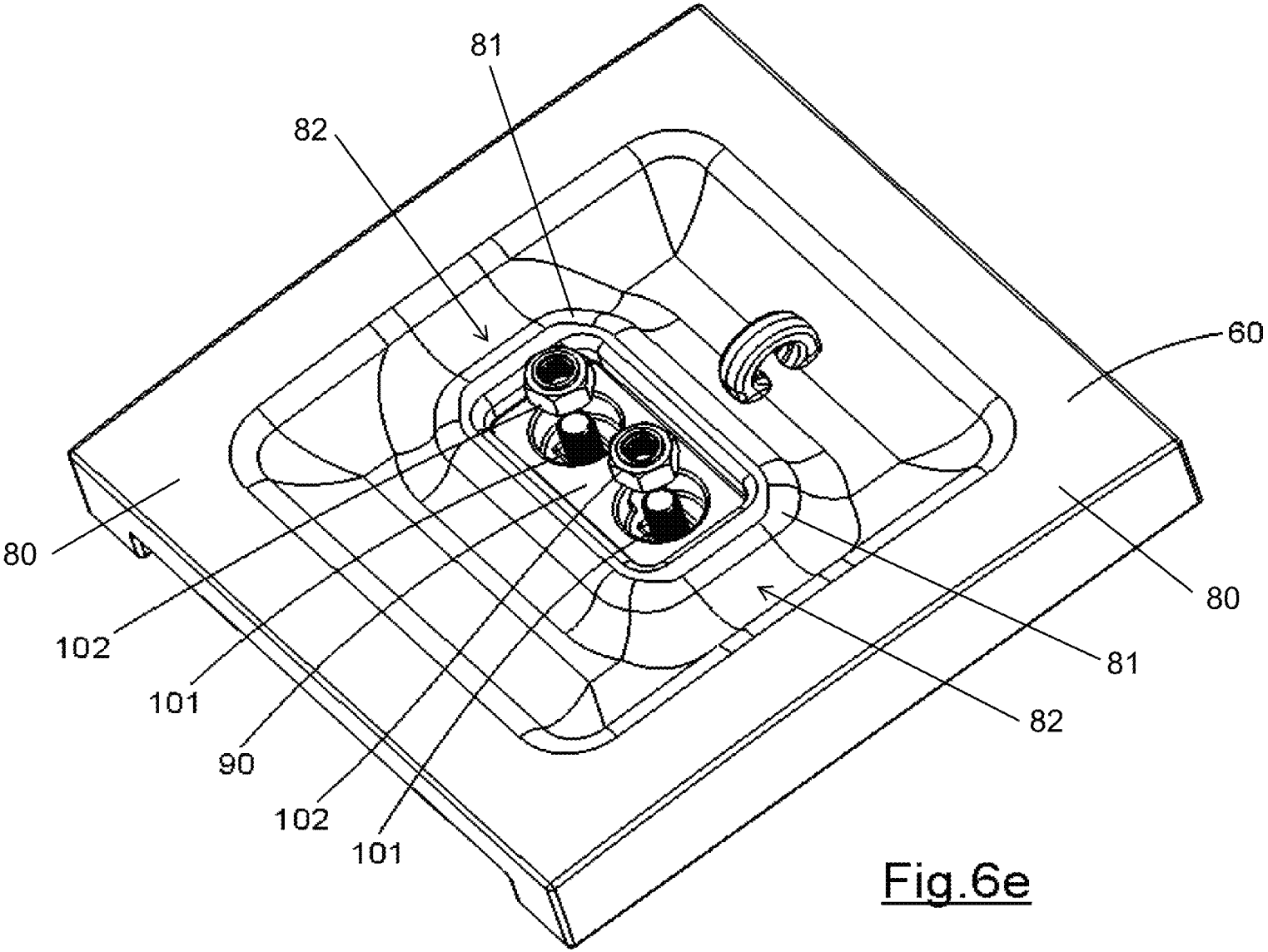
FIG. 6*e* is a pictorial representation of the mount of FIG. 3*a*, and the wear pad of FIG. 4*a* with the locking member fitted and the nuts loose.
Figure 6F:
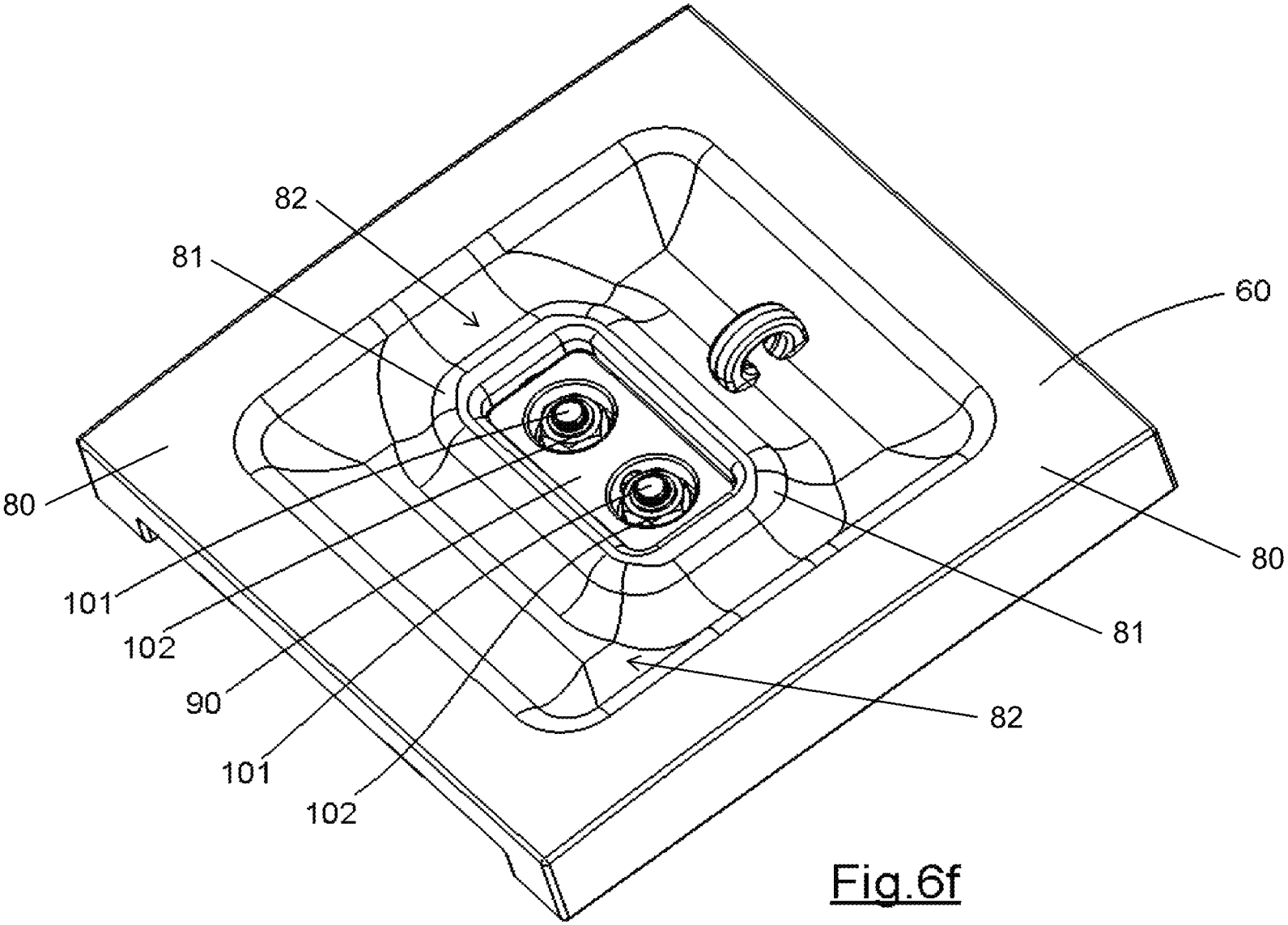
FIG. 6*f* is a pictorial representation of the mount of FIG. 3*a*, and the wear pad of FIG. 4*a* with the locking member fully fitted to lock the wear pad to the locking member which has already been welded to the bucket panel.
Figure 7A:
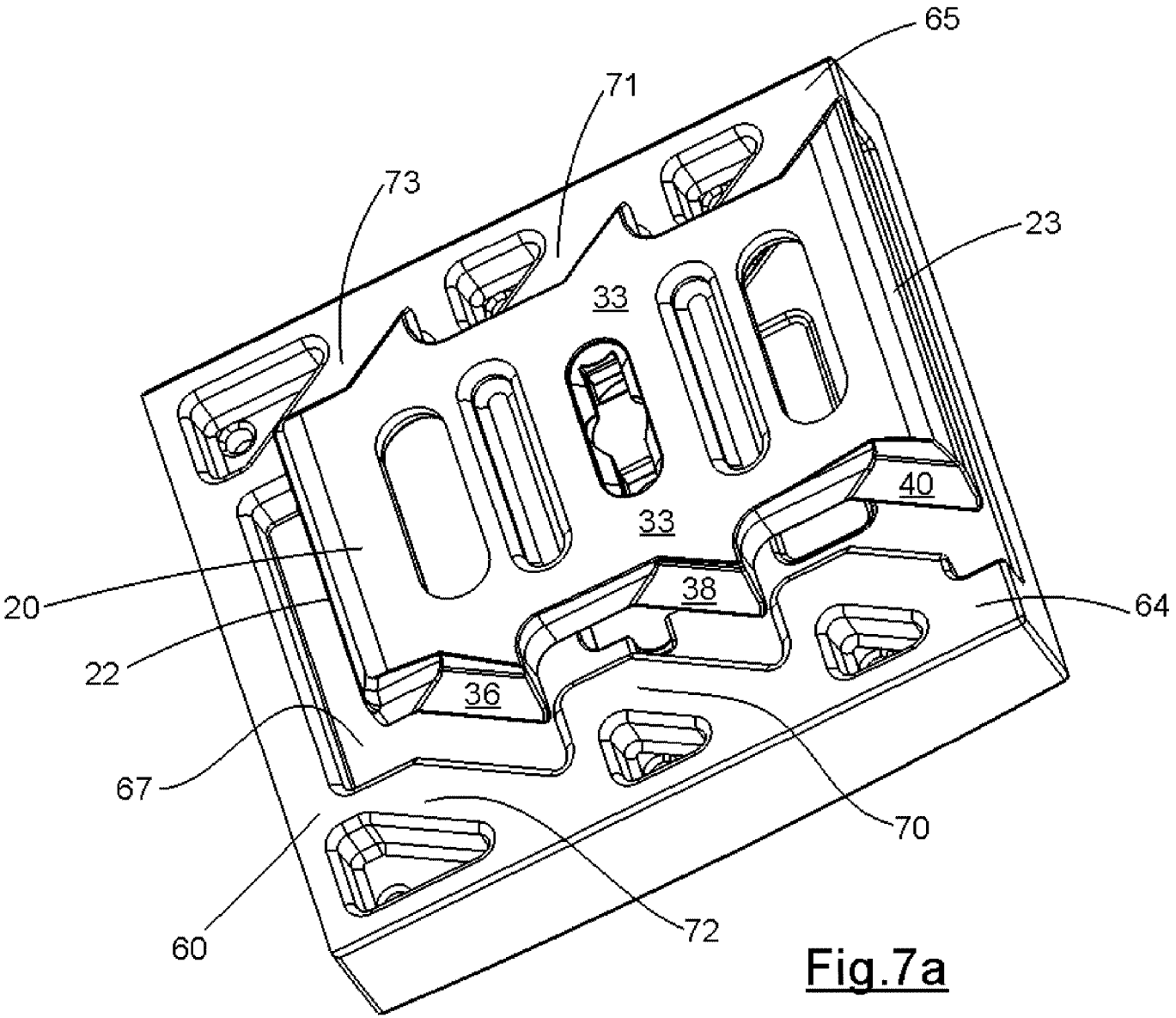
FIG. 7*a* is an upside down pictorial representation of the first stage of fitting the wear pad of FIG. 4*a* to the weld on mount of FIG. 3*a* with the wear pad ready to be pushed onto the weld on mount into the release position.
Figure 7B:
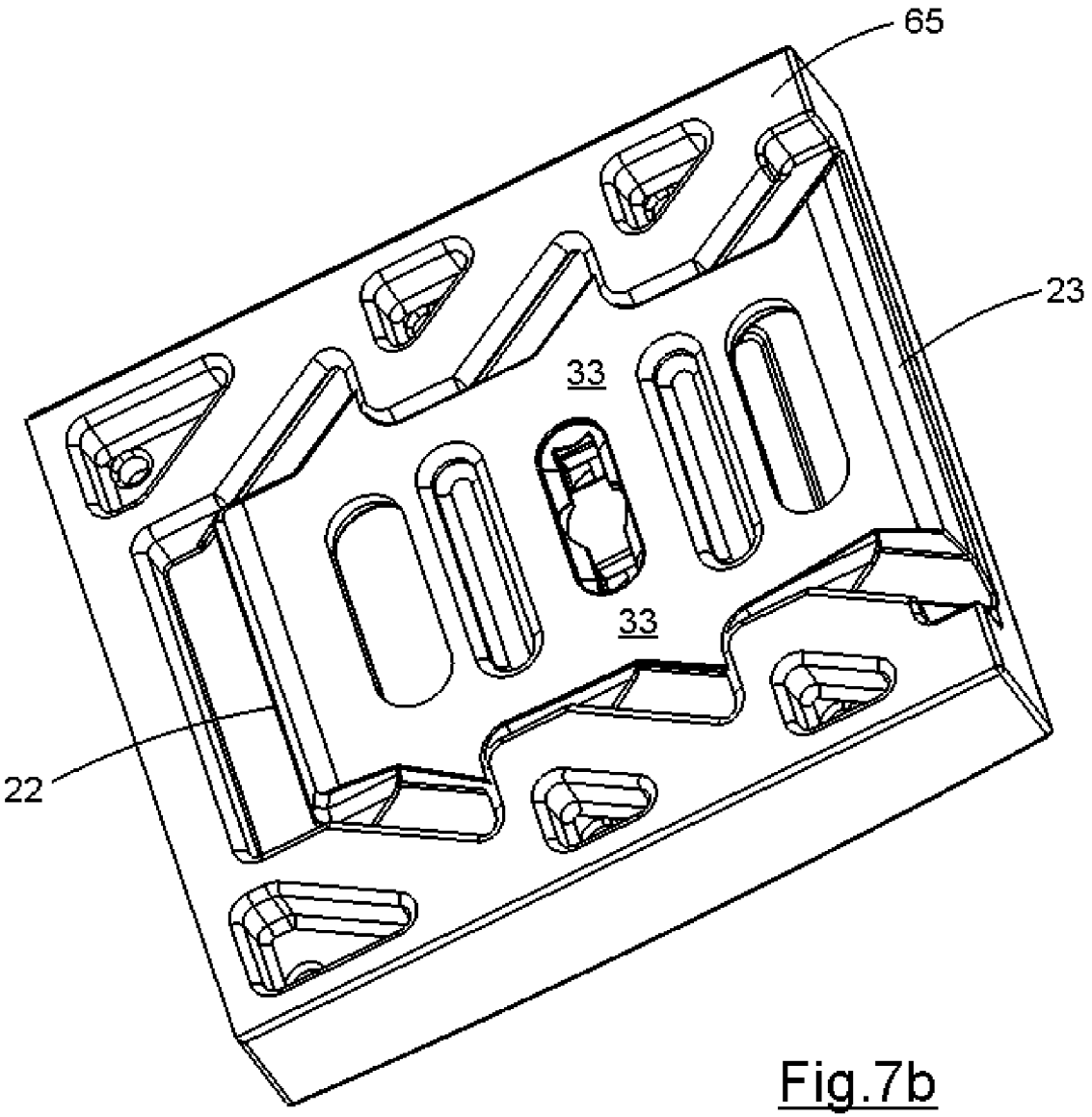
FIG. 7*b* is an upside down pictorial representation of the second stage of fitting the wear pad of FIG. 4*a* to the weld on mount of FIG. 3*a* with the wear pad already pushed onto the weld on mount and in the release position.
Figure 7C:
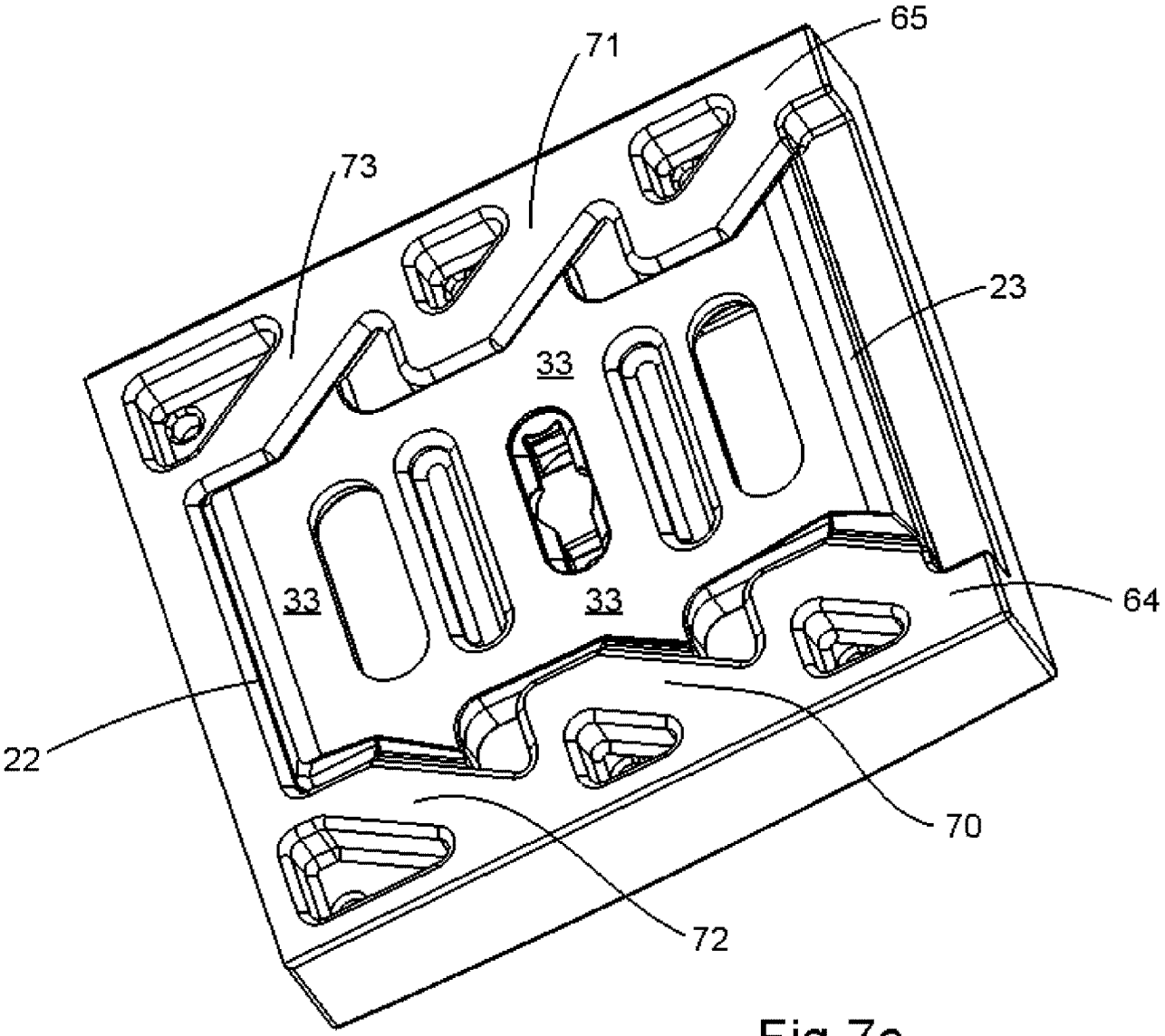
FIG. 7*c* is an upside down pictorial representation of the third stage of fitting the wear pad of FIG. 4*a* to the weld on mount of FIG. 3*a* with the wear pad already slid into the engaged position.
Figures 7D, 7E:
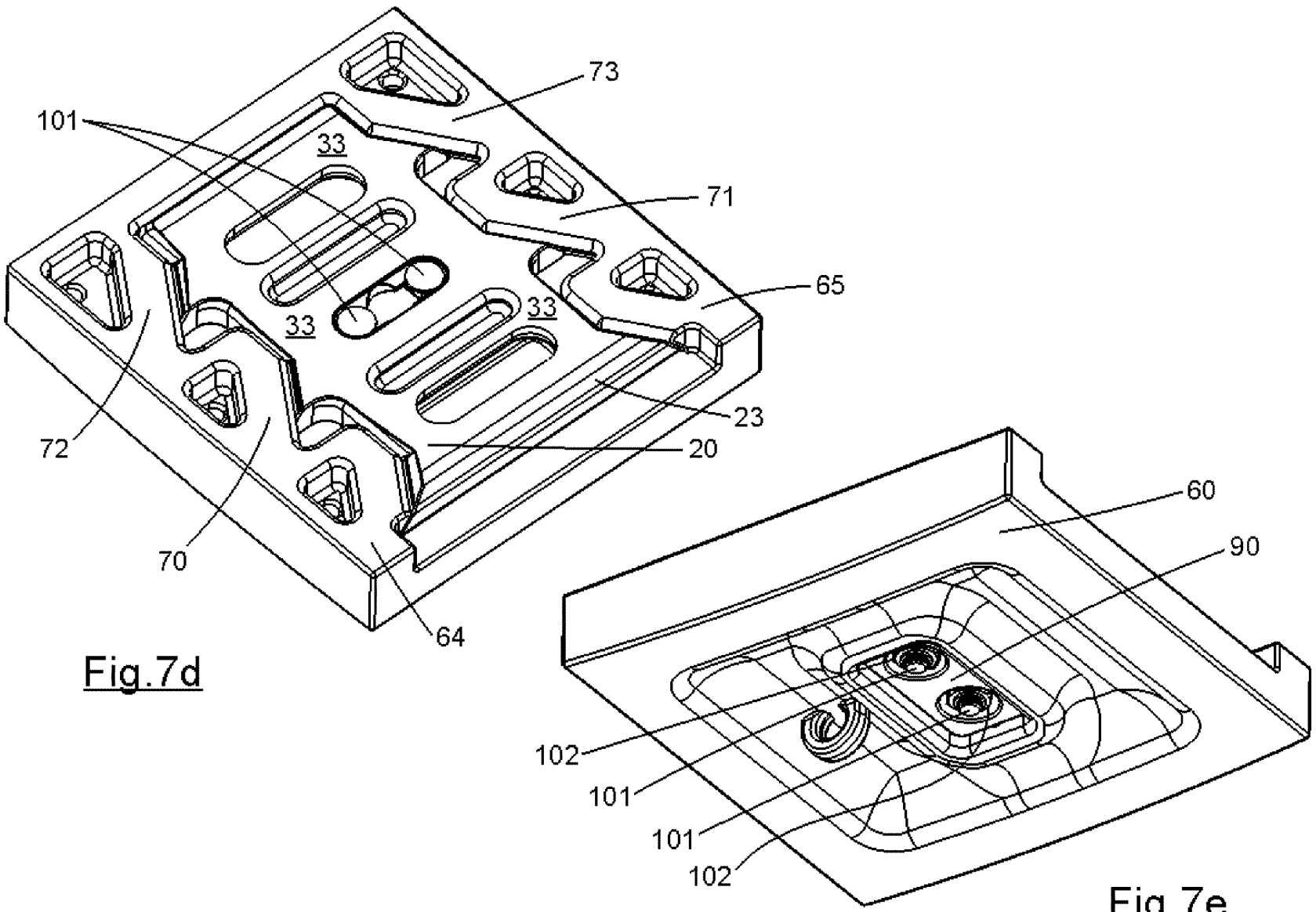
FIG. 7*d* is an underside view of the wear pad of FIG. 4*a* fitted to the weld on mount of FIG. 3*a* but with the plow bolts omitted.
FIG. 7*e* is a view of the wear pad of FIG. 4*a* fitted to the weld on mount of FIG. 3*a* from the outer face with the locking member and plow bolts fitted.
Figure 8A:
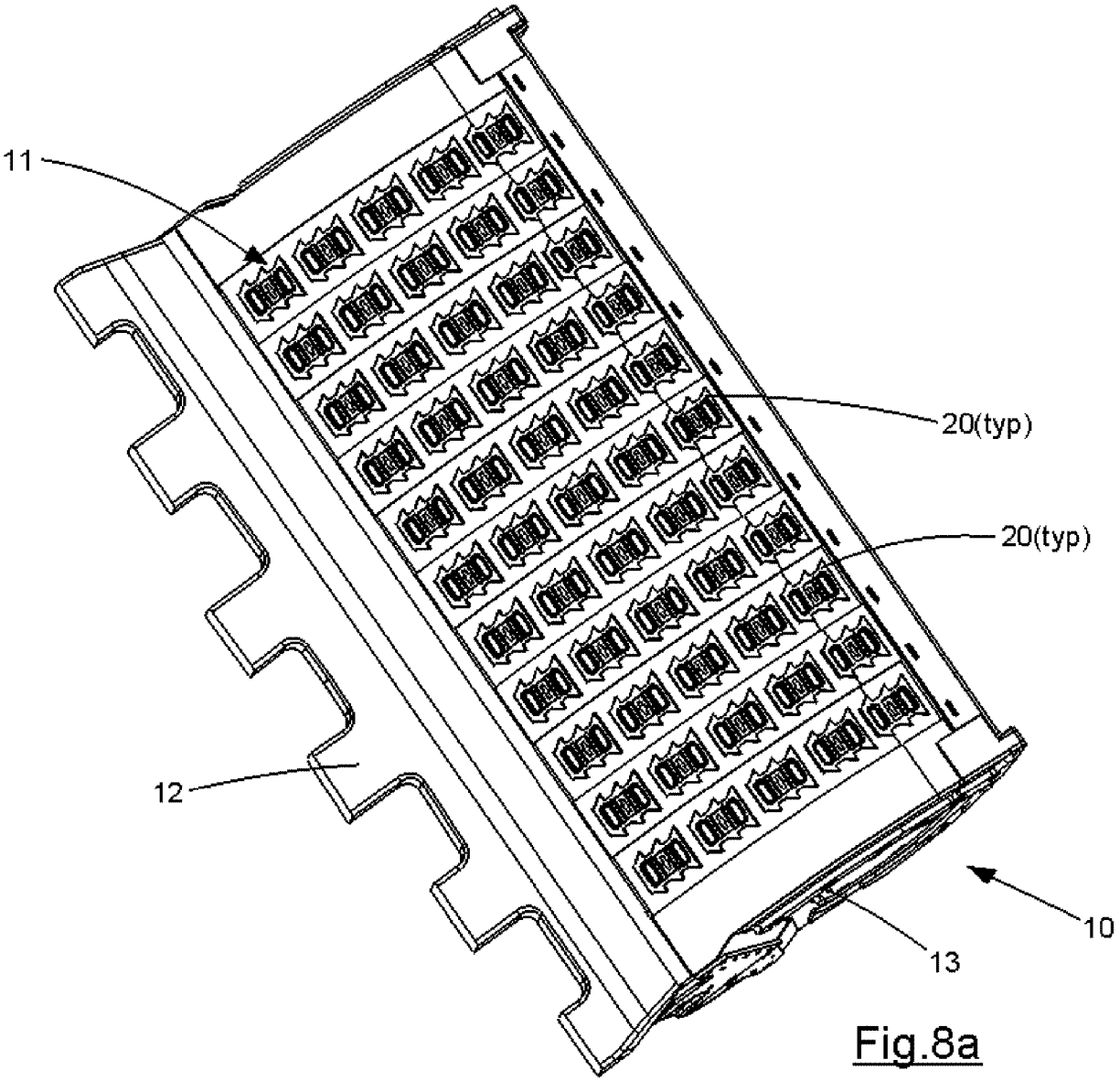
FIG. 8*a* is a pictorial representation of the underside of a face shovel bucket with the requisite number of weld on mounts of the type illustrated in FIG. 3*a* welded to the underside of the bucket ready to receive thereon the corresponding number of wear pads of the type illustrated in FIG. 4*a;*
Figure 8C:
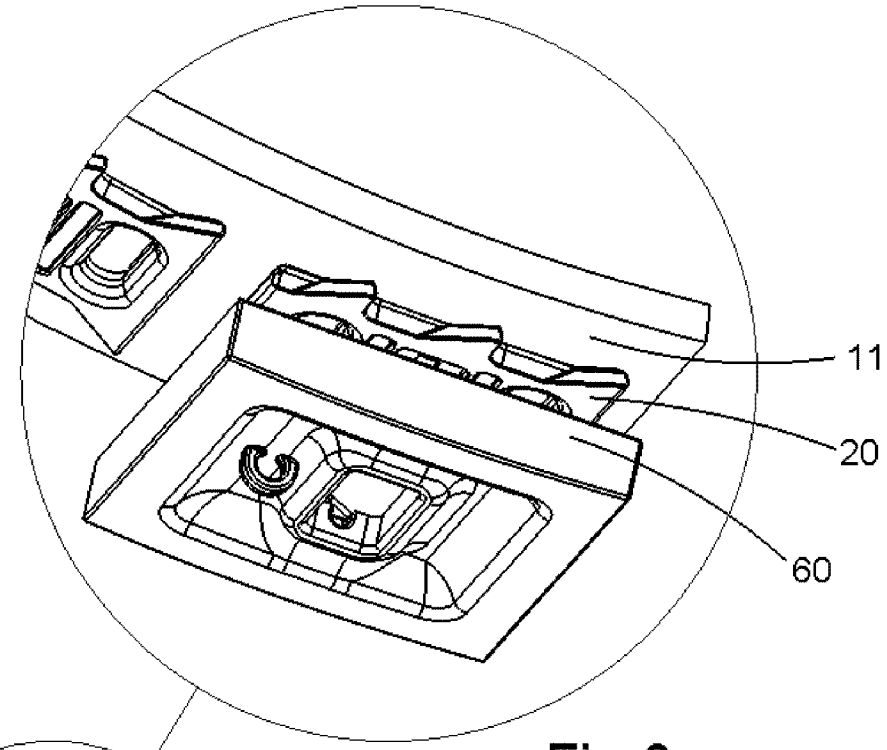
FIG. 8*b* and FIG. 8*c* are pictorial representations of the wear pads of the type illustrated in FIG. 4 are a being fitted to one column of weld on mounts.
Figure 8B:
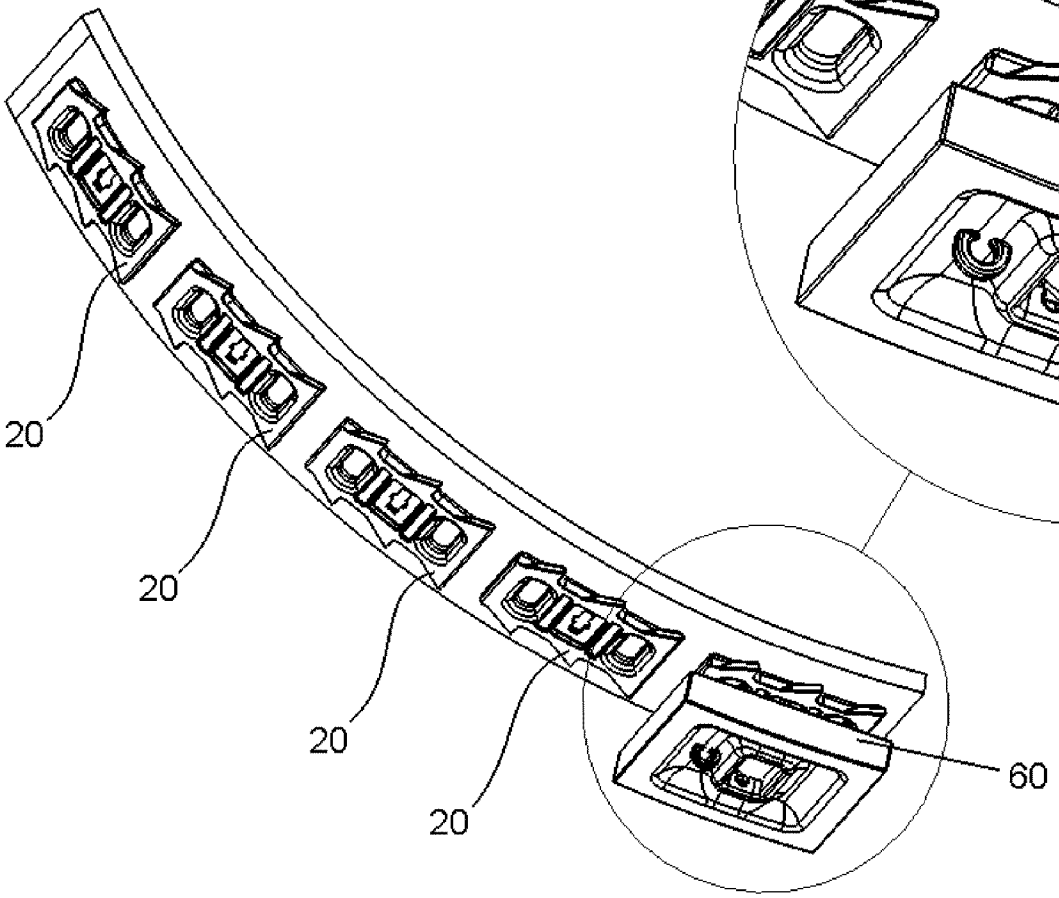
Figure 8D:
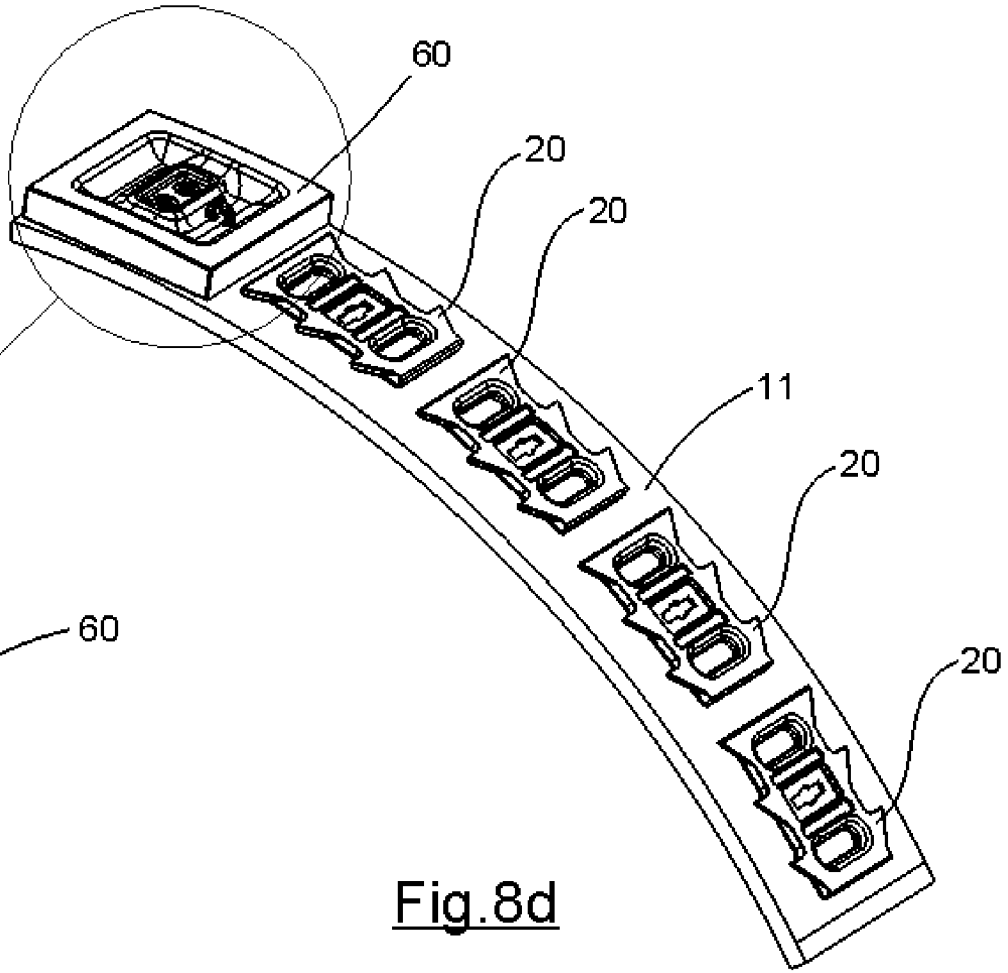
FIG. 8*d* and FIG. 8*e* are pictorial representations of two wear pads already fitted to two weld on plates.
Figure 8E:
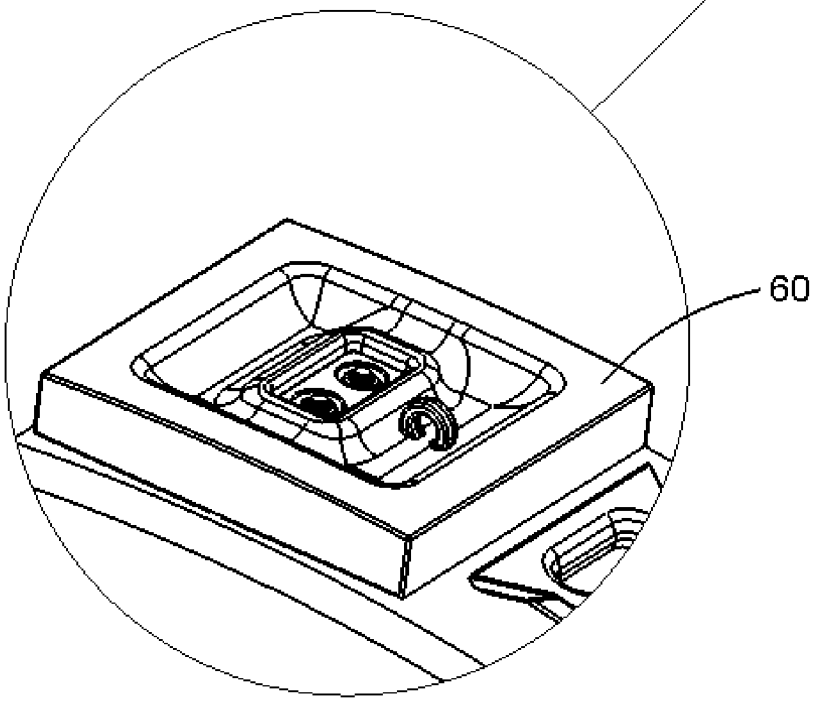
Figure 8G:
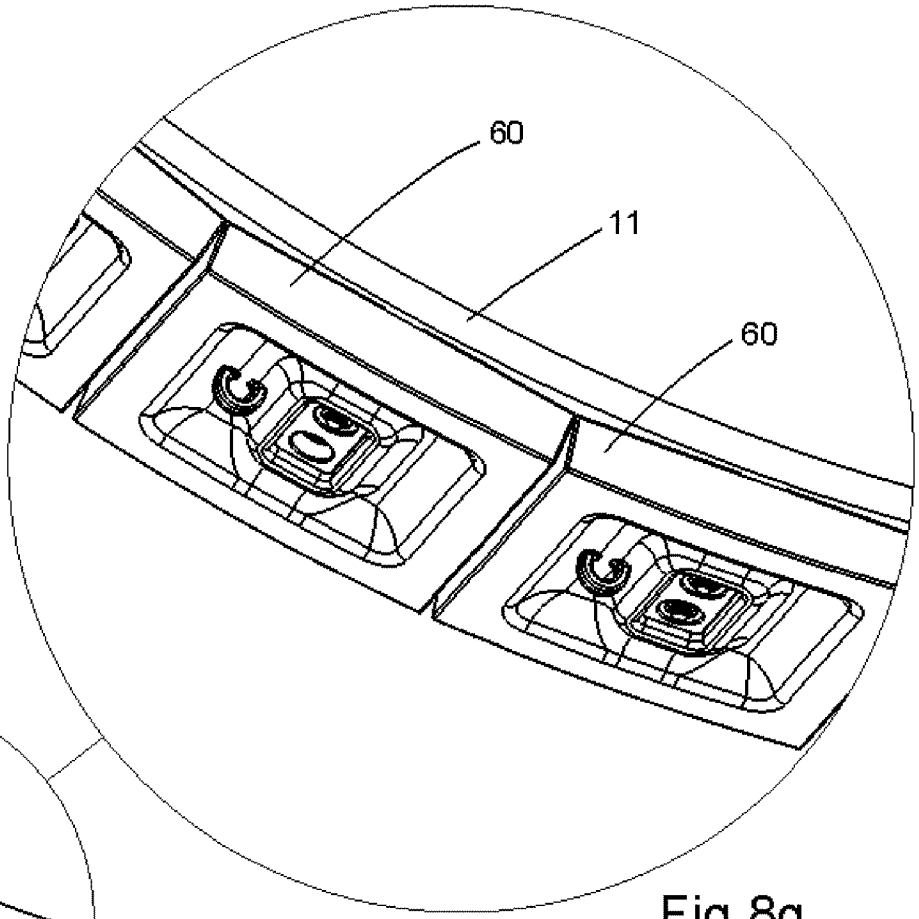
FIG. 8*f* and FIG. 8*g* are pictorial representations of a wear pad fitted to one mount in a column of weld on mounts.
Figure 8F:
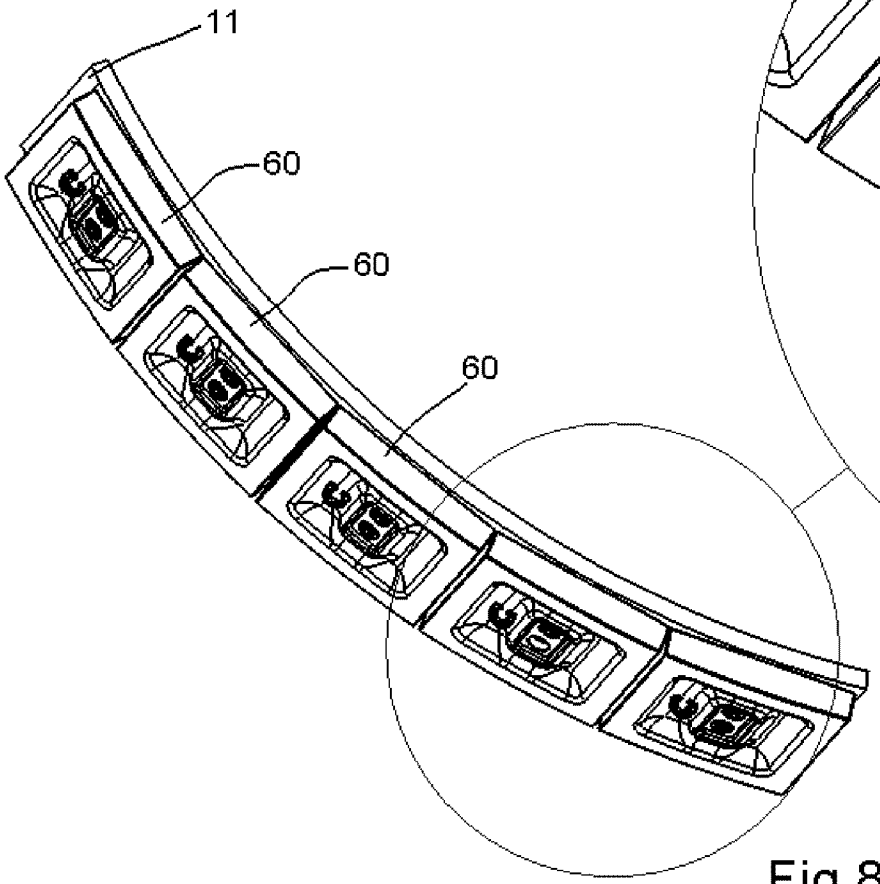
Figure 9:
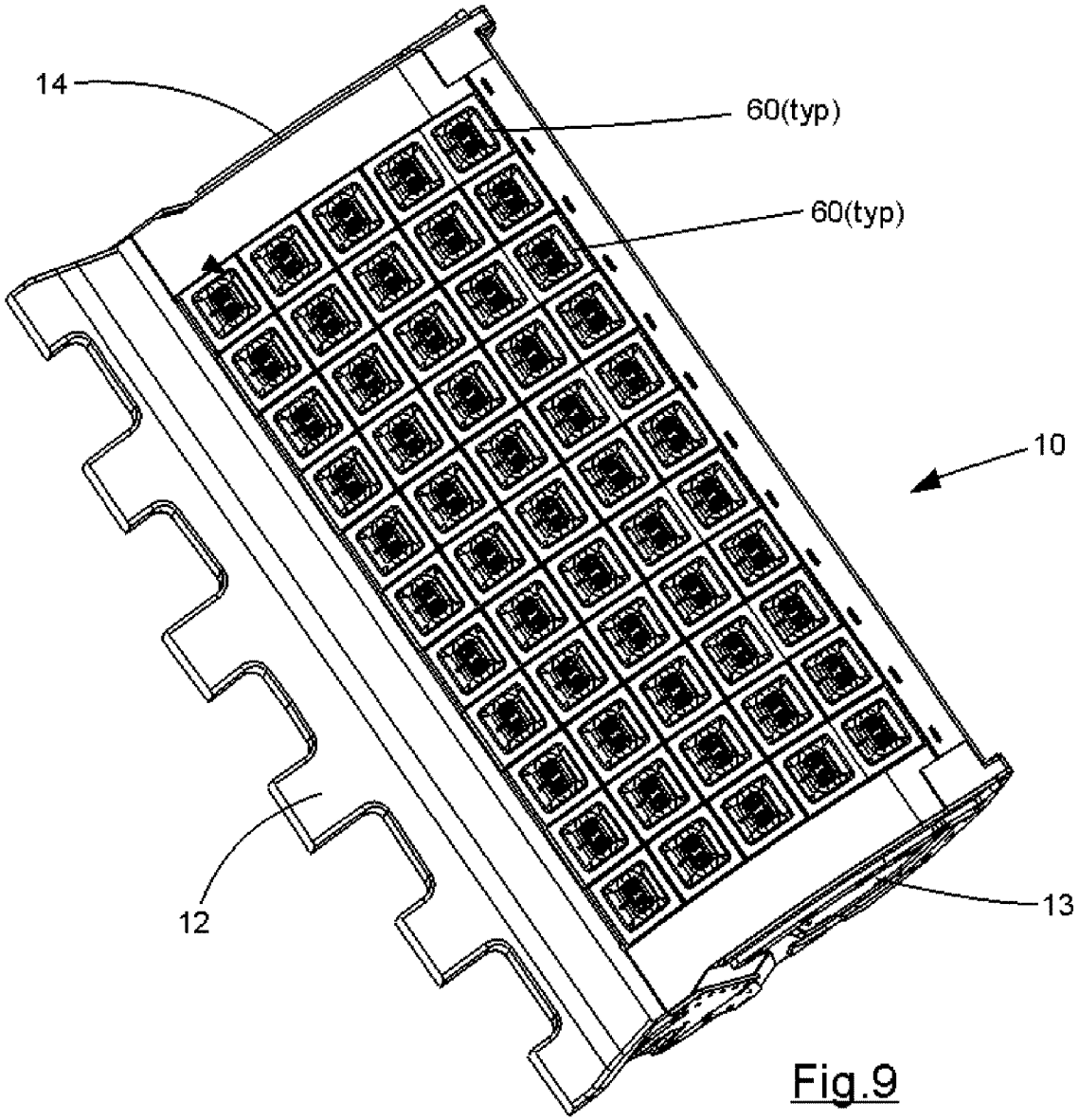
FIG. 9 is a pictorial representation of the underside of the face shovel bucket with wear pads fully fitted across the bottom face.

Referring to FIGS. 6*d*-6*f*, once the plow bolts are in position, the locking member is slid onto the two bolts 101 and then the nuts 102 are screwed onto the bolts and tightened thereby pulling the locking block into the passage 86 of the wear pad 60 and partially through that passage to engage in recess 48 of the mount 20. It will be appreciated that movement of the wear pad relative to the mount is prevented by engagement of the leading face of the locking member with the leading face of recess 48 and passage 86 as well as engagement of the trailing face of the locking member with the trailing face of recess 48 and passage 86.

As can be seen in FIG. 4*b*, a plurality of blind recesses 85 are provided in the wear pad and those passages terminate at a plane parallel to inner face 67 to provide a suitable wear indicator to the extent that a machine operator will know when to replace the pads when those passages become visible.

While the foregoing description has been given by way of illustrative example of the invention, it will be understood that the invention may be embodied in many other forms and all such forms are deemed to forward in the broad scope and ambit of the invention as defined by the appended claims or described herein.

The claims defining the invention are as follows:

1. A protection system including:

a planar or substantially planar mount adapted to be fixed to a planar or substantially planar surface of a wear panel of equipment or machinery, said mount having a lower face adapted to conform to and rest against the planar or substantially planar surface of the wear panel to be protected and an upper face spaced from said lower face;

a planar or substantially planar wear pad having a lower face adapted to be releasably mounted to the upper face of said mount to protect said wear panel against wear, the wear pad having an upper face spaced from the lower face of the wear pad and configured to bear against ore or spoil to be moved;

a locking member adapted to releasably lock said wear pad to said mount;

said mount and said wear pad having complementary fixed engagement means adapted to allow relative sliding movement between said mount and said wear pad from a release position in which said wear pad rests against said mount and can be pushed along said mount in one direction to a secured position or in an opposite direction to the release position in which the wear pad can be lifted from said mount;

said mount and said wear pad each having an opening or recess extending respectively through the lower and upper faces of the mount and the wear pad and adapted to receive said locking member at least partially therein, said opening or recess in each being arranged to at least partially align when said mount and said wear pad are in an engaged position such that said locking member extends from said opening or recess in said wear pad into said opening or recess in said mount so as to prevent sliding movement of said wear pad relative to said mount at least towards the release position;

said mount further having at least one passage extending from said lower face into said opening or recess in said mount and adapted to slidably receive therein one or more bolts;

said at least one passage in said mount having a narrow end portion and a larger portion contiguous with said narrow end portion, said narrow end portion being selected to slidably receive therein a respective shank of the one or more bolts for lateral movement thereof relative to the narrow end portion and the larger portion being selected to axially receive a respective head of the one or more bolts therethrough, wherein each of the one or more bolts is selectively fitted to the mount from above by pushing each respective head of the one or more bolts through the larger portion and then sliding each respective shank of the one or more bolts laterally into the narrow end portion where each respective head of the one or more bolts engages the lower face of the narrow end portion adjacent the at least one passage and the one or more bolts are retained in a non-rotatable state by the narrow end portion of the at least one passage;

said locking member also including at least one passage, said at least one passage being aligned with said at least one passage in said mount such that the one or more bolts extending through said at least one passage in said mount also extend through said at least one passage in said locking member; and wherein the one or more bolts extending through said at least one passage in said mount and said at least one passage in said locking member are arranged substantially perpendicular to said lower and upper faces of said mount to at least in part secure said locking member to said planar or substantially planar mount.

2. A mount for a protection system, said mount including:

a first portion having a longitudinal axis and a lower face adapted to rest against a face of a wear panel to be protected and an upper face spaced from said lower face;

one or more fixed protuberances extending outwardly in a lateral direction from the longitudinal axis of said first portion and on opposite sides thereof, each of said one or more fixed protuberances having a face which is inclined upwards and outwards from said lower face and extends towards one end of said first portion and terminates at said upper face; and said first portion having an opening or recess extending therein from said upper face and at least one passage extending from said lower face into said opening or recess, said at least one passage having a narrow end portion and a larger portion contiguous with said narrow end portion, said narrow end portion being selected to slidably receive therein a shank of a bolt and/or a locking portion of a head of a bolt for lateral movement thereof relative to the first portion and the larger portion being selected to axially receive the head of the bolt therethrough, wherein the bolt is selectively fitted to the mount from above by pushing the head of the bolt through the larger portion and then sliding the shank and/or locking portion of the bolt laterally into the narrow end portion where the head of the bolt engages the lower face of the first portion adjacent the at least one passage and the bolt is retained in a non-rotatable state by the narrow end portion of the at least one passage.

3. The protection system according to claim 1, wherein said at least one passage extending from said lower face into said opening or recess includes a portion adapted to receive therein a head of each of the one or more bolts, a depth of such portion being selected so that the head of each of the one or more bolts does not protrude beyond the lower face of the mount.

4. The protection system according to claim 1, wherein the one or more bolts selected are one or more plow bolts and a head portion of the recess is shaped to suit a size and shape of the head portion of each of the one or more plow bolts.

5. The protection system according to claim 1, wherein said at least one passage in said mount is a single passage having narrow end portions and a larger intermediate portion, the narrow end portions being selected to slidably receive a shank of the one or more bolts or a locking portion of a corresponding head of the one or more bolts for lateral movement and the larger intermediate portion being selected to axially receive the corresponding head of the one or more bolts, wherein each of the one or more bolts is selectively fitted to the mount from above by pushing each corresponding head through the larger intermediate portion and then sliding each of the one or more bolts laterally towards either end portion where the corresponding head of the one or more bolts then engages the lower face of the mount adjacent the single passage.

6. The protection system according to claim 5, wherein a width of the narrow end portions is selected to engage with a square locking portion of the one or more bolts or the corresponding head of the one or more bolts to prevent the one or more bolts from turning relative to the single passage.

7. The protection system according to claim 5, wherein a depth of a head portion of the recess is selected to ensure that the locking portion of each corresponding head of the one or more bolts is retained in the narrow end portions so that a nut can be screwed onto each of the one or more bolts without rotation of the one or more bolts.

8. The protection system according to claim 1, wherein the mount has one or more openings extending therethrough to provide suitable locations for welding the mount to the wear panel to be protected.

9. The protection system according to claim 8, wherein the mount has at least two openings extending laterally across the mount, one being wherein a first opening is positioned near one end of the mount and a second opening is positioned near an opposite end of the mount.

10. The protection system according to claim 1, wherein said complementary fixed engagement means includes a tapered portion or portions and a complementary tapered recess or recesses, the tapered portion or portions and the complementary tapered recess or recesses being arranged to force the wear pad into closer face-to-face engagement with the mount as the wear pad is pushed along said mount in said one direction.

11. The protection system according to claim 1, wherein the complementary fixed engagement means include tapered portions arranged to tighten the wear pad onto the mount against lateral movement and twisting and pivoting movement as the wear pad is pushed from the release position to the secured position.

12. The protection system according to claim 1, wherein the complementary fixed engagement means includes a tapered portion or portions and complementary tapered recess or recesses, the tapered portion or portions and complementary tapered recess or recesses being arranged to force the wear pad into closer face-to-face engagement with the mount and to tighten the wear pad onto the mount against lateral movement and twisting and pivoting movement as the wear pad is pushed from the release position to the secured position.

13. The protection system according to claim 1, wherein said mount includes a first portion having a lower face adapted to rest against a face of the wear panel to be protected and at least two protuberances extending from each side of said first portion, said at least two protuberances on each side being spaced apart in a direction from end to end.

14. The protection system according to claim 13, wherein at least two protuberances extending from each side of the first portion of the mount includes three protuberances extending from each side of said first portion, the three protuberances being arranged in pairs, one protuberance of each pair being directly opposite a corresponding one protuberance on an opposing side of said first portion.

15. The protection system according to claim 1, wherein the at least one passage in said locking member includes a portion adapted to receive therein a corresponding nut of the one or more bolts, such portion being sufficient to accommodate a suitable spanner or socket for tightening or loosening the corresponding nut.

16. The protection system according to claim 1, wherein the locking member has recesses in each end and/or each side for engagement by a tool for removing the wear pad from the mount.

17. The protection system according to claim 1, wherein the locking member has a threaded jacking passage therein.

18. A wear pad for a protection system, the wear pad including:

a wear portion having an upper face adapted to bear against ore or spoil to be moved and a lower face spaced from said upper face and adapted to rest on a mount secured to a wear panel to be protected, said wear portion having a passage extending therethrough from said upper face to said lower face, said passage being dimensioned to receive a locking member wholly therein, said upper face being defined at least in part by an outer portion extending substantially about said passage;

two spaced-apart side portions extending or depending from said wear portion on opposite sides of said lower face to define a space therebetween and one or more fixed protuberances extending from each of said two spaced-apart side portions and projecting into the space therebetween towards an opposite one of the two spaced-apart side portions and spaced from said lower face, each of said one or more fixed protuberances having a face which is inclined in a downwards and inwards direction away from said lower face and extends towards one end of said wear portion, said one or more fixed protuberances being spaced laterally away from said passage, and the inclined faces being arranged so as to tighten the wear pad onto the mount against movement along the mount and sidewards of the mount when fitted thereto; and wherein the upper face of the wear portion includes a raised perimeter portion, a raised interior portion extending at least substantially about a perimeter of the passage, and a channel or valley portion formed between said raised perimeter portion and the raised interior portion, said raised perimeter portion and the channel or valley portion extending at least substantially about said passage, and wherein said raised perimeter portion has a height extending in a direction normal to the lower face of said wear pad that is greater than heights of said channel or valley portion and said raised interior portion extending at least substantially about the passage.

19. The wear pad according to claim 18, wherein said wear pad includes a wear indicator which indicates when the wear pad has worn to a predetermined state, and wherein said wear indicator includes at least one blind passage in each of said two spaced-apart side portions, said at least one blind passage includes a smaller portion indicating a first predetermined wear state and a larger portion indicating a second predetermined wear state.

* * * * *